US011246788B2

(12) United States Patent
Kao

(10) Patent No.: US 11,246,788 B2
(45) Date of Patent: Feb. 15, 2022

(54) SPINE REGULARITY ROTATION MOTION DEVICE

(71) Applicant: Jui-Ting Kao, Taipei (TW)

(72) Inventor: Jui-Ting Kao, Taipei (TW)

( * ) Notice: Subject to any disclaimer, the term of this patent is extended or adjusted under 35 U.S.C. 154(b) by 185 days.

(21) Appl. No.: 15/817,257

(22) Filed: Nov. 19, 2017

(65) Prior Publication Data

US 2020/0323725 A1 Oct. 15, 2020

(30) Foreign Application Priority Data

Mar. 6, 2017 (TW) ..... 106107271

(51) Int. Cl.
*A61H 1/02* (2006.01)
*A61H 1/00* (2006.01)

(52) U.S. Cl.
CPC ..... *A61H 1/0296* (2013.01); *A61H 1/005* (2013.01); *A61H 1/0229* (2013.01); *A61H 2201/0176* (2013.01); *A61H 2201/1215* (2013.01); *A61H 2201/1652* (2013.01); *A61H 2203/0431* (2013.01)

(58) Field of Classification Search
CPC ..... A61H 1/001; A61H 1/003; A61H 2001/0203; A61H 1/0222; A61H 2001/0233; A61H 11/00; A61H 2201/1418; A61H 2201/1427; A61H 2201/1436; A61H 2201/1604; A61H 2201/1607; A61H 2201/1609; A61H 2201/1619; A61H 2201/1621; A61H 2201/1623; A61H 2201/1626; A61H 2201/1628; A61H 2201/163; A61H 2201/1633; A61H 2203/0425; A61H 23/00; A61H 23/02;
(Continued)

(56) References Cited

U.S. PATENT DOCUMENTS 2,665,685 A * 1/1954 Kaufman ..... A61H 1/0229 602/32
3,088,457 A * 5/1963 Dersch ..... A61H 1/02 601/98

(Continued)

FOREIGN PATENT DOCUMENTS

BE 900182 A * 11/1984 ..... A61H 1/0229
DE 4233606 C1 * 10/1993 ..... A61H 1/0218

(Continued)

*Primary Examiner* — Timothy A Stanis
*Assistant Examiner* — Matthew R Moon

(57) ABSTRACT

A spine regularity rotation motion device includes a T-shaped hanger, a neck traction belt, an n-shaped base, and a horizontal rotary drive platform, wherein the T-shaped hanger is connected to the neck traction belt via a pulling belt at one end, and is connected to the n-shaped base through a main elevating post at another end. A user can rest his face on the neck traction belt, which is gently pulled upwards to increase the space between the cervical joints and align the spine to the center. The horizontal rotary drive platform is provided inside the n-shaped base with a correction seat on the top for the user to sit on. The seat allows the hip of the user to move in a regularity rotation manner that is opposite to the directions of the twisted and/or bent lumbar spine or skewed pelvis. An underarm support is also provided to raise the spine and reduce stacking to facilitate the rehabilitation process.

3 Claims, 25 Drawing Sheets

(58) Field of Classification Search
CPC ..... A61H 23/0254; A61H 1/005; A61H 2201/0138; A61G 15/007
See application file for complete search history.

(56) References Cited

U.S. PATENT DOCUMENTS 3,824,991 A * 7/1974 Whitaker ..... A47C 9/002 601/5
5,113,851 A * 5/1992 Gamba ..... A47C 9/002 297/330
5,365,621 A * 11/1994 Blain ..... A61G 7/1017 5/83.1
5,716,331 A * 2/1998 Chang ..... A61H 1/005 601/28
5,868,687 A * 2/1999 Tedesco ..... A61H 1/00 601/49
8,496,605 B1 * 7/2013 Chavers ..... A61F 5/055 602/32
2003/0130602 A1 * 7/2003 Chang ..... A61H 23/0263 601/49
2008/0146357 A1 * 6/2008 Hsu ..... A63B 69/04 472/59
2009/0050187 A1 * 2/2009 Lamb ..... A61H 3/04 135/67
2010/0210978 A1 * 8/2010 Oddsson ..... A61H 1/0229 601/24
2010/0258152 A1 * 10/2010 Lin ..... A61H 3/00 135/67
2016/0058659 A1 * 3/2016 Angelov ..... A45D 29/007 601/73
2017/0021230 A1 * 1/2017 Osler ..... A47C 9/002
2017/0113097 A1 * 4/2017 Wu ..... A63B 26/00
2018/0064988 A1 * 3/2018 Xu ..... A63B 24/0087
2018/0207048 A1 * 7/2018 Janzen ..... A61H 1/0292

FOREIGN PATENT DOCUMENTS

JP 2004121854 A * 4/2004
JP 2009066194 A * 4/2009

* cited by examiner

SPINE REGULARITY ROTATION MOTION DEVICE

BACKGROUND OF THE INVENTION

1. Field of the Invention

The invention relates to a regularity rotation motion device applicable to lumbar physiotherapy, and more particularly, to a lumbar regularity rotation motion device capable of redressing the lumbar spine to its correct angle or location.

2. Description of the Prior Art

The skeletal system of the human body is like steel bars that support a building. The skeletal system is like a "skeleton axis"; the head is like the roof, and the pelvis is like the foundation. When the axis is deformed, the person may experience pain or soreness. More severe deformation in the "skeletal axis" may be physically visible, for example, symptoms like one side of the shoulders being higher than the other side, Thoracic scoliosis, waist bending, humpback, pelvic skew, hip overturned or excessively flat etc. may be observed. Slight deformation may not be easily observed and can sometimes be overlooked. If the real cause of a discomfort is not identified, the body may be suffering from long-term pain, soreness or numbness.

Therefore, it is important to prevent or redress symptoms caused by deformation of the skeleton axis. Of course, prevention requires early detection, early intervention in posture correction and continuous tracking to avoid excessive deterioration. Early detection and intervention eliminate the need for invasive surgical treatment in the future.

One conventional technique involves a thoracic scoliosis brace embedded at either side of the chest of a patient and used in conjunction with a bed disclosed in U.S. Pat. No. 8,882,802 titled "Chiropractic Machine" or TW Patent No. I324511 titled "Three Dimensional Vector Spine Rehabilitation Device", which includes a total of four sets of adjustable safety belts and sections to gradually relieve symptoms such as vertebral soreness, thoracic scoliosis or waist bending, in the end help restore patient's spine to the normal angle or location.

In U.S. Pat. No. 8,882,802, a spine massage machine is disclosed, which mainly includes a base, a pelvic section, an abdominal section, a leg section, a head section, a cervical traction section, and mattresses. One side of an elevating post installed at the base is connected to the pelvic section, while the other side is connected to the abdominal section. A motion device driven by a drive device is provided at the base, its swing shaft is connected to a second drive device and is secured at the bottom part of the pelvic section to push the pelvic section up and down. The second drive device is capable of adjusting the up and down swing angle of the pelvic section. A third drive device is provided at the front section of the center axis of the pelvic section, its end is connected to a lower side of a pelvic seat to rotate the pelvic section. A fourth drive device connected with a sliding bracing frame is provided at the middle section of the pelvic seat to allow the pelvic seat to move back and forth. Another side of the pelvic section is connected with the leg section. A fifth drive device connected with the elevating post is provided at one side of the abdominal section to allow the abdominal section to swing left and right. The abdominal section is also connected to the head section. A supporting rod of a sixth drive device is provided below the head section to allow up and down movement of the head section. The front end of the head section is connected to the cervical traction section. The cervical traction section has a supporting rod with a seventh drive device attached to a traction rod to allow rotation of the cervical section. The various drive devices are separately controlled manually or with a computer program to assist in spine rehabilitation to address the syndromes of cervical vertebrae bending, thoracic vertebrae bending, vertebral errors, adhesion, and prominent cartilage etc.

In view of the above drawbacks, the present invention is developed to address the abovementioned disadvantages.

SUMMARY OF THE INVENTION

One main objective of the present invention is to provide a lumbar regularity rotation motion device capable of redressing deformed and twisted lumbar spines through horizontal rotation motion.

Another objective of the present invention is to provide a lumbar regularity rotation motion device that allows users to make adjustments and traction themselves. This can be an active therapy performed before operations to allow gradual rehabilitation or even render the operations unnecessary.

Still another objective of the present invention is to provide a lumbar regularity rotation motion device that can be controlled in a wired or wireless manner manually or through a computer controlled program to collectively or individually adjust various parts of the body according to the best input data to accommodate different need and symptoms.

Yet another objective of the present invention is to provide a lumbar regularity rotation motion device that helps user achieve safe rehabilitation and correction of cervical vertebrae, thoracic vertebrae, lumbar spine and pelvis by pulling from potentially different directions and angles in combination with a horizontal rotary drive platform.

In order to achieve the above objectives and efficacies, the technical means employed by the present invention may include: a base including an enclosure with an opening on one side and a main elevating post sheath mount extending vertically from a side of the enclosure opposite to the opening; a hanger including: a main elevating post sheathed in the main elevating sheath mount, a first power telescopic actuator fastened to the main elevating post at one end, a pulling belt fastened to the first power telescopic actuator at one end, and an arm extending perpendicularly from the main elevating post including a pulley at the distal end for guiding the pulling belt; a neck traction belt held in suspension on the other end of the pulling belt via the pulley; and a horizontal rotary drive platform including: a horizontal turntable driven by a motor gear set, and a seat provided on top of the horizontal turntable for moving in a rhythmic manner actuated by the horizontal turntable.

Based on the structure above, the correction seat may be a curved seat with a curved top surface and a flat bottom surface; a balance disk with curved top and bottom surfaces; or a balance ball with a flat top surface and a semi-circular bottom surface.

Based on the structure above, when the first power telescopic actuator of the T-shaped hanger generates a pulling force, the neck traction belt is pulled through the traction rod by the pulling belt and is able to lift the head of a user up and increase the space between the cervical joints and align the skeleton axis. The first power telescopic actuator can be replaced with weights.

Based on the structure above, when the second power telescopic actuator of the n-shaped base generates a pushing force, the right handle pad connected with the right elevating post and the left handle pad connected with the left elevating post are pushed upwards. As such, the spine is raised to reduce stacking, such that there is no gravity oppression from the scapula to the pelvis of the lumbar spine in order to help redress the spine to its correct place.

Based on the structure above, the n-shaped base includes first to fourth adjustment belt mounts which wrap around the chest and apply forces to chest from the right and/or the left to gradually guide the spines of patients with thoracic scoliosis back to the centerline. Based on the above structure, the horizontal rotary drive platform rotates clockwise or anti-clockwise at a speed of 10~60 times per minute from the pelvic area to redress the spine through reverse mechanics.

Based on the above structure, when a user sits on the correction seat, the underlying horizontal turntable, the horizontal rotary motor gear setting platform, the motor gear set, and the vibrator become closely connected and create high-speed vertical vibration, which helps loosen the spine joints and speed up the redressing process.

The objectives, efficacies and features of the present invention can be more fully understood by referring to the drawing as follows:

BRIEF DESCRIPTION OF THE DRAWINGS

FIG. 3-1 is an isometric exploded view depicting a third adjustment belt mount shown in FIG. 3.

FIG. 3-2 is an isometric exploded view depicting a first embodiment of underarm rods mounted on left and right elevating crossbars.

FIG. 3-3 is an isometric exploded view depicting a second embodiment of the underarm rods.

FIG. 12-1 is a partially enlarged view of section A of FIG. 12 showing a first regularity rotation motion pattern of the lumbar spine.

FIG. 12-2 is a partially enlarged view of section A of FIG. 12 showing a second regularity rotation motion pattern of the lumbar spine.

FIG. 14-1 is a partially enlarged view of section B of FIG. 14 showing a third regularity rotation motion pattern of the lumbar spine.

FIG. 14-2 is a partially enlarged view of section B of FIG. 14 showing a fourth regularity rotation motion pattern of the lumbar spine.

FIG. 16-1 is a partially enlarged view of section C of FIG. 16 showing a fifth regularity rotation motion pattern of the lumbar spine.

FIG. 16-2 is a partially enlarged view of section C of FIG. 16 showing a sixth regularity rotation motion pattern of the lumbar spine.

DETAILED DESCRIPTION OF THE PREFERRED EMBODIMENTS

Figure 1:
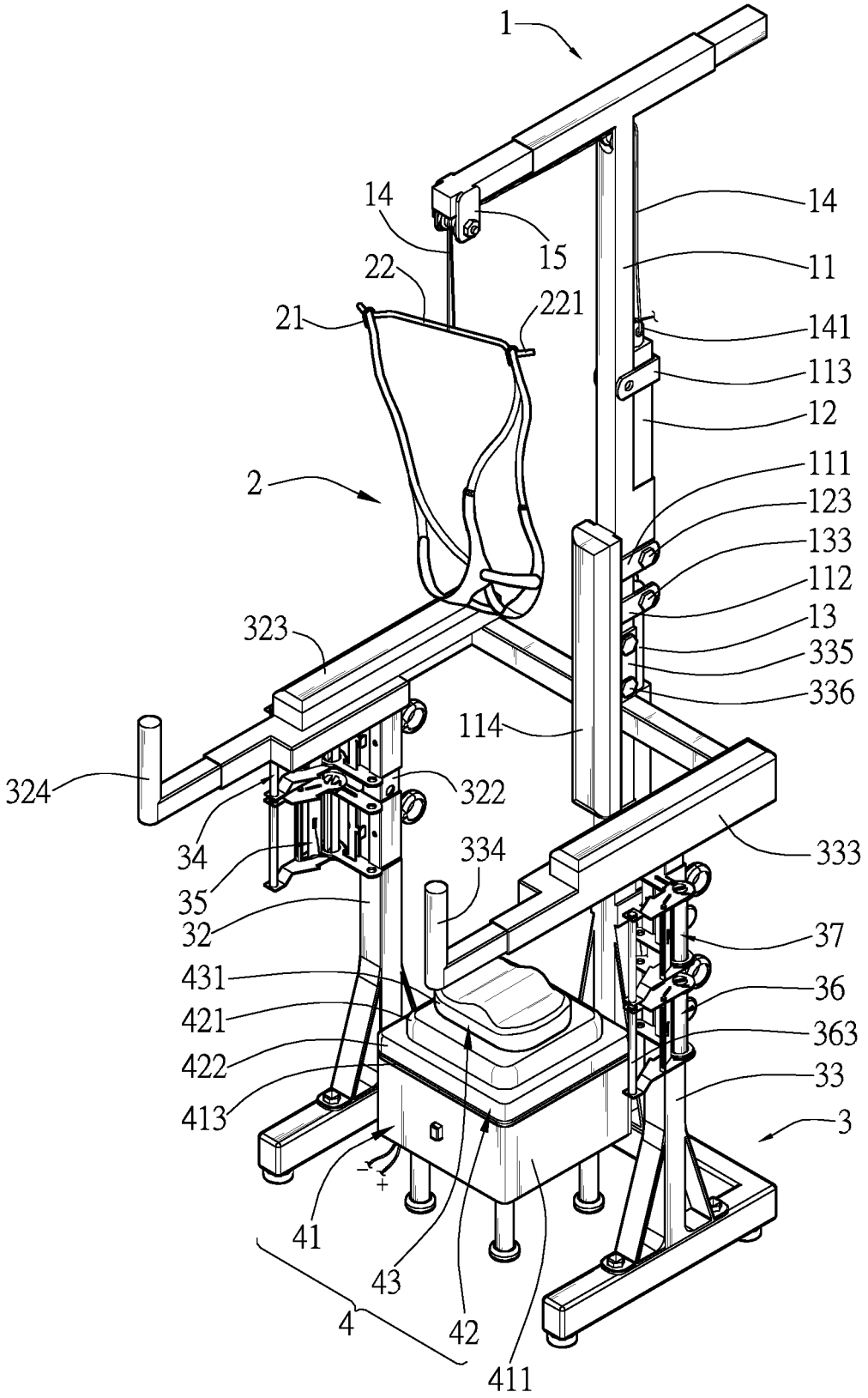
FIG. 1 an isometric view of the overall structure of the present invention.

Referring to FIGS. 1, 2, 3-1, 3-2, 3-3, 7 and 8, an isometric view of the overall structure, a first partial exploded view, a second partial exploded view, an isometric exploded view of a third adjustment belt mount, an isometric exploded view depicting a first embodiment of underarm rods, an isometric exploded view depicting a second embodiment of the underarm rods, an isometric exploded view of a horizontal rotary drive platform, an exploded view of a drive platform of the present invention are shown, respectively. The present invention can be set as being controlled automatically or manually by a computer controlled program in order to use and adjust various parts of the device collectively or individually according to the best input data. The lumbar regularity rotation motion device of the present invention includes: a T-shaped hanger 1, a neck traction belt 2, an n-shaped base 3 and a horizontal rotary drive platform 4. A main elevating post 11 is provided at an appropriate location of the T-shaped hanger 1. A first joining mount 111, a second joining mount 112 and a clamp mount 113 extend from two sides of the main elevating post 11 at suitable locations, while a soft padding 14 is provided at another side of the main elevating post 11. A first power telescopic actuator 12 and a second power telescopic actuator 13 are also provided at one side of the main elevating post 11. The first power telescopic actuator 12 can be replaced by hanging functionally equivalent weights of different weight. A joining hole 121 at one end of the first power telescopic actuator 12 is inserted into the first joining mount 111 to align with a hole 1111, and is secured via a screw 123 and a bolt 124. The other end of the first power telescopic actuator 12 is joined with a clip 141 of a pulling belt 14 via a through hole 122 and inserted through the clamp mount 113. The other end of the pulling belt 14 is guided by a pulley assembly 15. A joining hole 131 at one end of the second power telescopic actuator 13 is inserted into and fastened with a third joining mount 311 via a screw 133 and a bolt 134. The other end of the second power telescopic actuator 13 is inserted into and fastened with the second joining mount 112 via a screw 1321 and a bolt 1322. The neck traction belt 2 is extended on both sides by a traction rod 22 connected with the T-shaped hanger 1. A ring 21 is provided at each of the two ends 221 of the traction rod 22. The neck traction belt 2 passes through the rings 21 so as to be joined to the two ends 221 of the traction rod 22.

Figure 4:
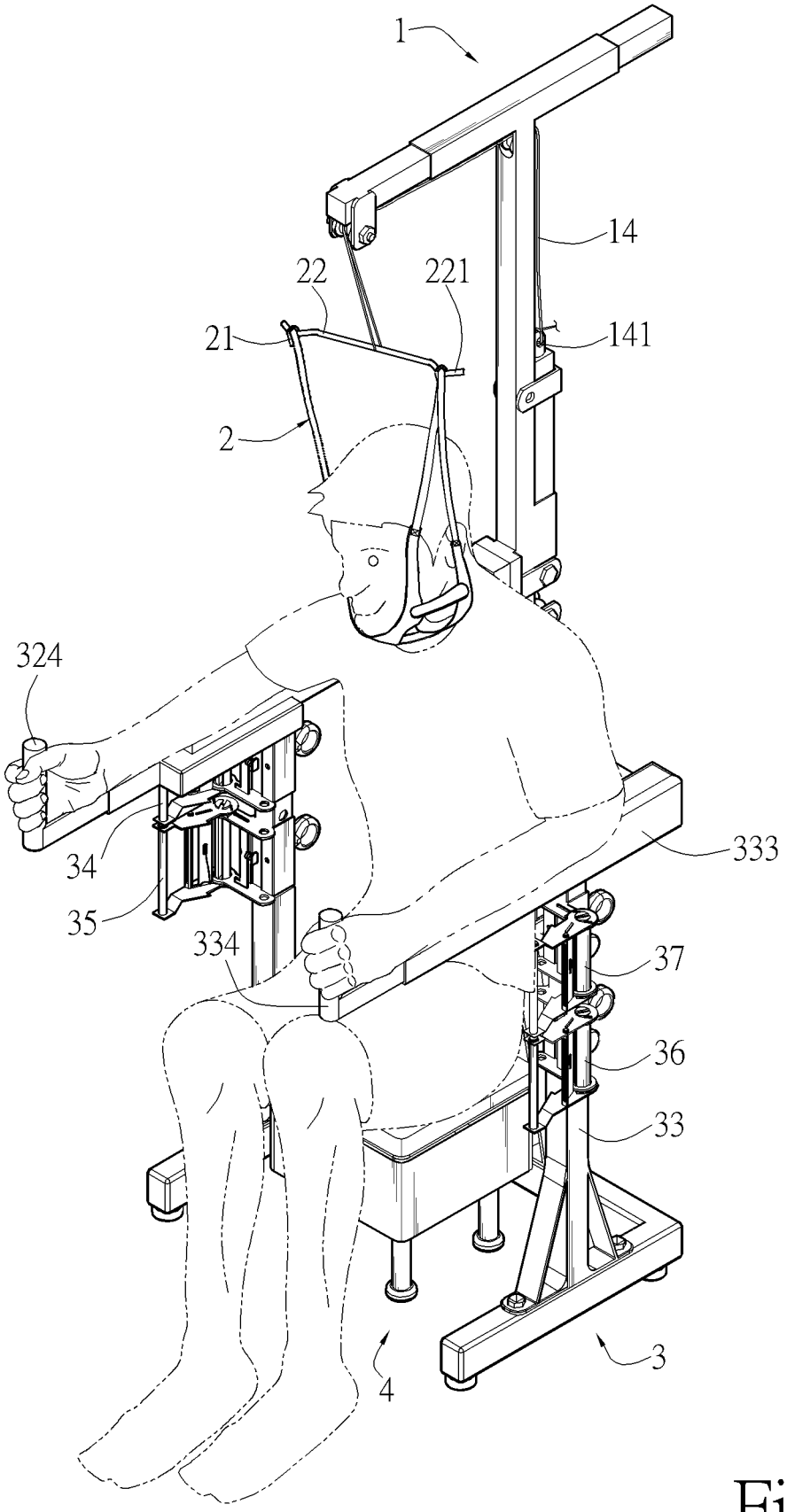
FIG. 4 is a schematic diagrams illustrating a neck traction belt of the present invention in use.
Figure 5:
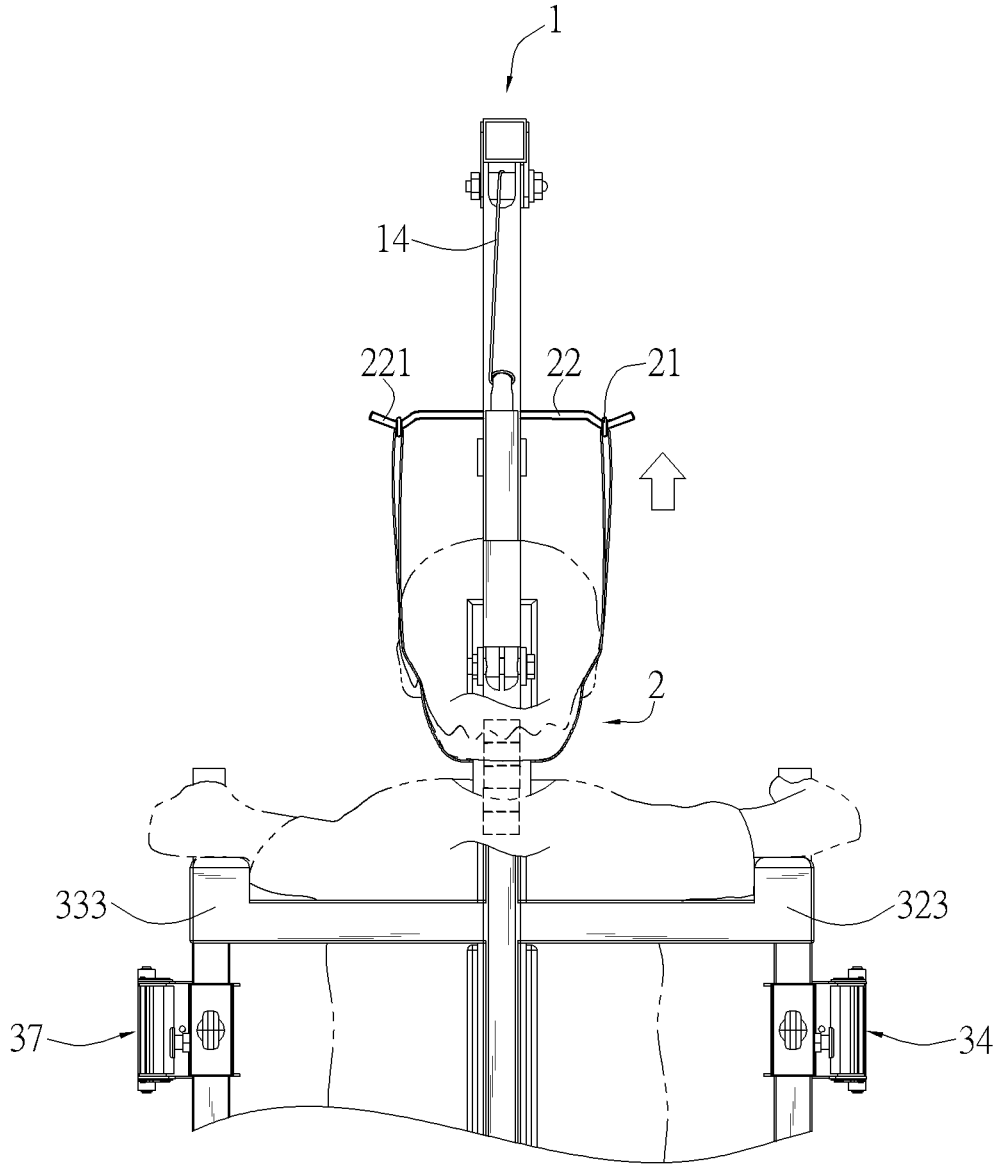
FIG. 5 is a back view of the neck traction belt of the present invention before adjustment.
Figure 6:
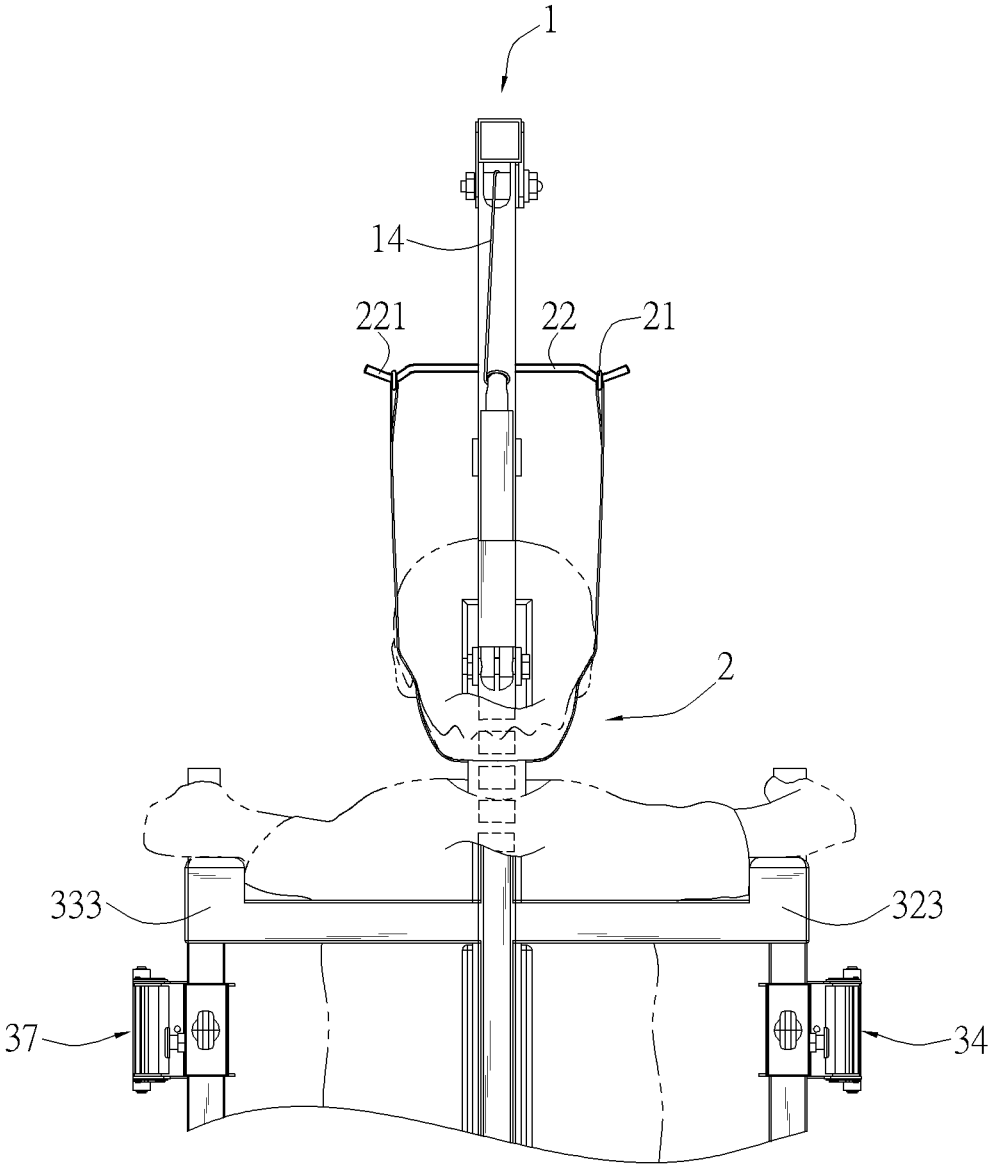
FIG. 6 is a back view of the neck traction belt of the present invention after adjustment.

Referring to FIGS. 4, 5 and 6, a schematic diagrams illustrating the present invention in use, a back view of the neck traction belt before adjustment, and a back view of the neck traction belt after adjustment are shown, respectively. When using the lumbar regularity rotation motion device of present invention, the chin of a user rests on the neck traction belt 2, and the neck traction belt 2 can be pulled through the pulling belt 14 fastened at the clip 141. As the clip 141 is secured to the through hole 122 of the first power telescopic actuator 12, the neck traction belt 2 can be pulled by shortening the first power telescopic actuator 12 accordingly. As a result, the head of the user can be gently lifted to increase the space between the cervical joints and aligned in the center, as can be seen in FIG. 6.

The main elevating post 11 of the T-shaped hanger 1 fits into the n-shaped base 3. More specifically, the main elevating post 11 is sheathed into an open-ended tube 312 of a main elevating post sheath mount 31. The third joining mount 311 extends from two sides of the main elevating post sheath mount 31 at a suitable location. A right elevating post sheath mount 32 and a left elevating post sheath mount 33 are provided at right and left sides of the n-shaped base 3, respectively. A right elevating post 322 having a plurality of holes 3221 can be inserted through an open-ended tube 341 of a first adjustment belt mount 34, then through an open-ended tube 351 of a second adjustment belt mount 35, and finally into an open-ended tube 321 of the right elevating post sheath mount 32. A right handle pad 323 extends on top of the right elevating post 322 with a telescopic right handle 324 extending from one end of the right handle pad 323. On the other side, a left elevating post 332 having a plurality of holes 3321 can be inserted through an open-ended tube 361 of a third adjustment belt mount 36, then through an open-ended tube 371 of a fourth adjustment belt mount 37, and finally into an open-ended tube 331 of the left elevating post sheath mount 33. A left handle pad 333 extends on top of the left elevating post 332 with a telescopic left handle 334 extending from one end of the left handle pad 333. Left and right handle joining parts 335 and 325 extend vertically from respective joining ends of the left and right handle pads 333 and 323. Holes 3351 and 3251 on the left and right handle joining parts 335 and 325 are aligned with a hole 115 on the main elevating post 11, such that the left and right joining parts 335 and 325 are secured to the main elevating post 11 via a screw 336 and a bolt 337. The first adjustment belt mount 34, the second adjustment belt mount 35, the third adjustment belt mount 36 and the fourth adjustment belt mount 37 of the n-shaped base 3 are similarly used for mounting a first adjustment belt 340, a second adjustment belt 350, a third adjustment belt 360 and a fourth adjustment belt 370, respectively, such that two adjustment belts are assembled on each side of the device.

The details of the adjustment belt mounts 34-37 will now be explained using the third adjustment belt mount 36 as an example. The third adjustment belt mount 36 includes a fixed frame 362 and a moveable frame 363 combined together by two semi-circular pivot shafts 3621*a* and 3621*b*. Pins 3263 passing through holes 36211*a* and 36211*b* at either end of the shafts 3621*a* and 3621*b* are inserted and fastened inside holes 36241 of upper and lower plates 3624. Ratchets 3622*a* and 3622*b* are fitted on two ends of the shafts 3621*a* and 3621*b*. Then, semi-circular holes 36311*a* and 36311*b* on one end of wing plates 3631 are further fitted on two ends of the shafts 3621*a* and 3621*b*. A guide slot 3626 is provided on each of upper and lower plates 3624 of the fixed frame 362 to allow a snap fastener 3625 to elastically slide back and forth inside the slot 3626. An elastic element is sheathed on the snap fastener 3625. A guide slot 3633 is provided on upper and lower wing plates 3631 of the moveable frame 363 to allow a moveable element 3632 to elastic slide back and forth within the guide slot 3633. An elastic element 3634 is hooked onto the moveable element 3632 at a suitable location. A handle rod 3635 is sandwiched between ends of the wing plates 3631. Circular recesses 36351*a* and 36351*b* are provided at both ends of the handle rod 3635 and are combined with C-shaped fasteners 3638*a* and 3638*b* to be fitted inside holes 36312. A connecting rod 3637 is further provided in the middle of the wing plates 3631. Fasteners 3638 are provided on both ends of the connecting rod 3637 so as to be fitted in the upper and lower wing plates 3631. The third adjustment belt 360 sleeves the connecting rod 3637 at one end; inserts between the two semi-circular pivot shafts 3621*a* and 3261*b*; and comes out from the handle rod 3635. The moveable element 3632 controls the length of the third adjustment belt 360 and secures it in place. In addition, a pipe 3629 extends from one side of the fixed frame 362 for receiving a positioning rod 3628 sheathed with an elastic element 36201 and two clips 3622 correspondingly placed at a groove 362811 of a first neck portion 36281 and a groove 362821 of a second neck portion 36282. The positioning rod 3628 is secured to the pipe 3629 via a fastener 36283. The open-ended tube 361 of the third adjustment belt mount 36 is sleeved onto the left elevating post 332, and the positioning rod 3628 can be selectively inserted into one of the holes 3321 of the left elevating post 332 depending on the desired height of the belt.

Figure 10:
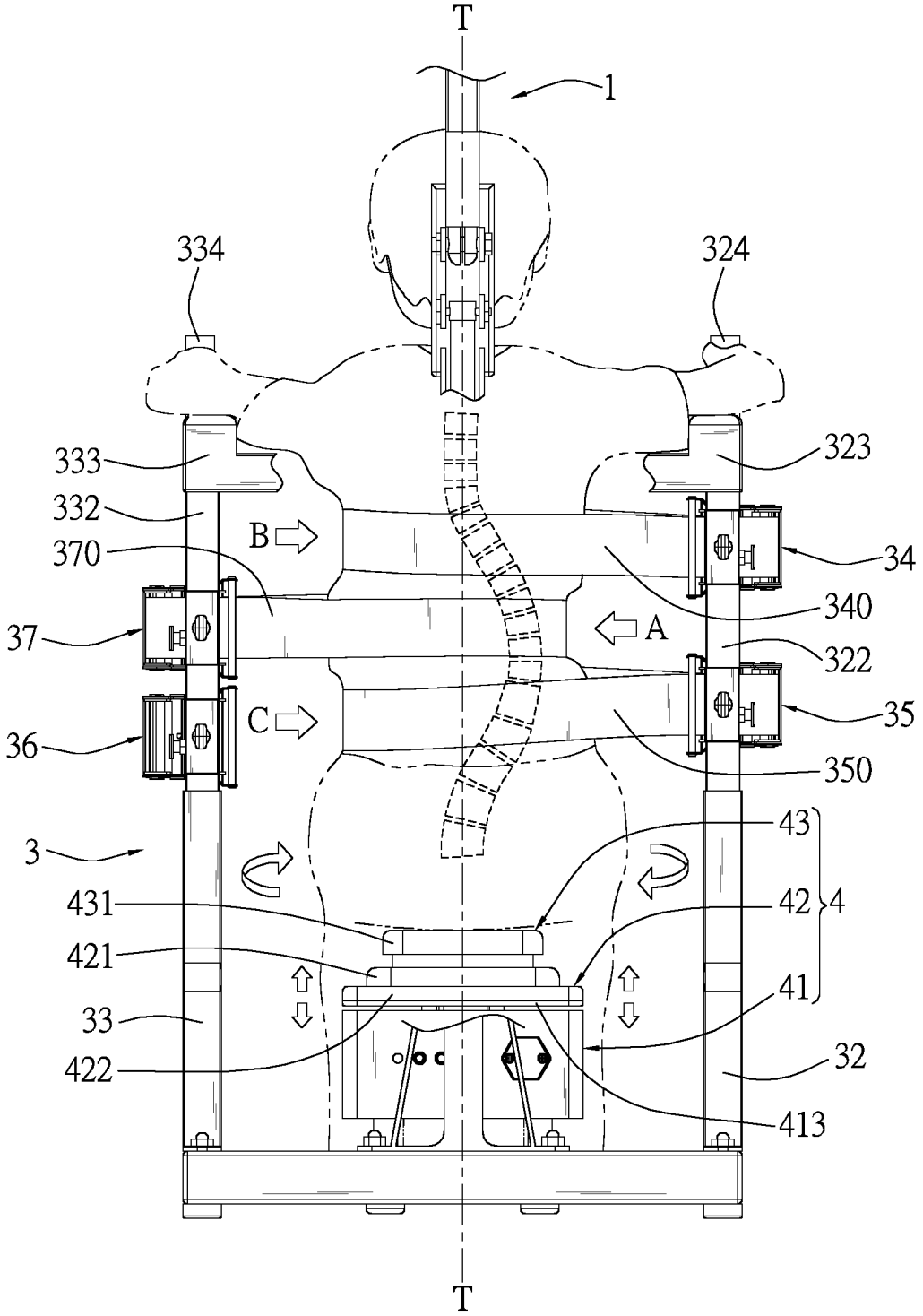
FIG. 10 is a back view of the ventral thoracic spine before adjustment belts of the present invention are applied.
Figure 11:
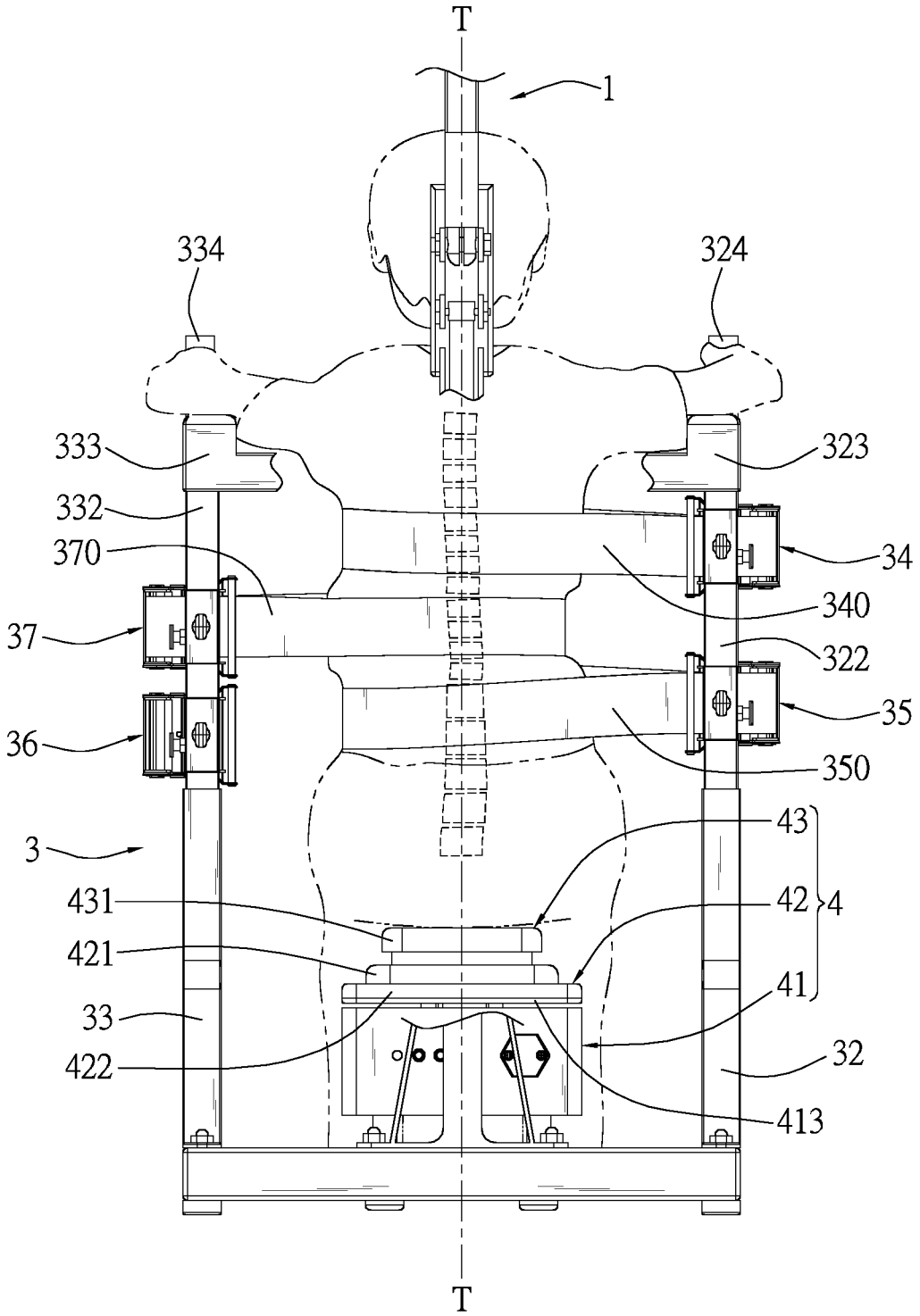
FIG. 11 is a back view of the ventral thoracic spine after adjustment belts of the present invention are applied.

Referring to FIGS. 10 and 11, a back view of the ventral thoracic spine before adjustment belts are applied and a back view of the ventral thoracic spine after adjustment belts are applied are shown, respectively. In FIG. 10, only three of the four adjustment belts 340-370 are used for strapping around the chest of the user at different heights. The adjustment belts 340 and 350 are pulled towards the right as indicated by arrows B and C, while the adjustment belt 370 is pulled towards the left as indicated by arrow A. For users who are suffering from thoracic scoliosis, this may gradually return the spine to the center as shown in FIG. 11.

Figure 2:
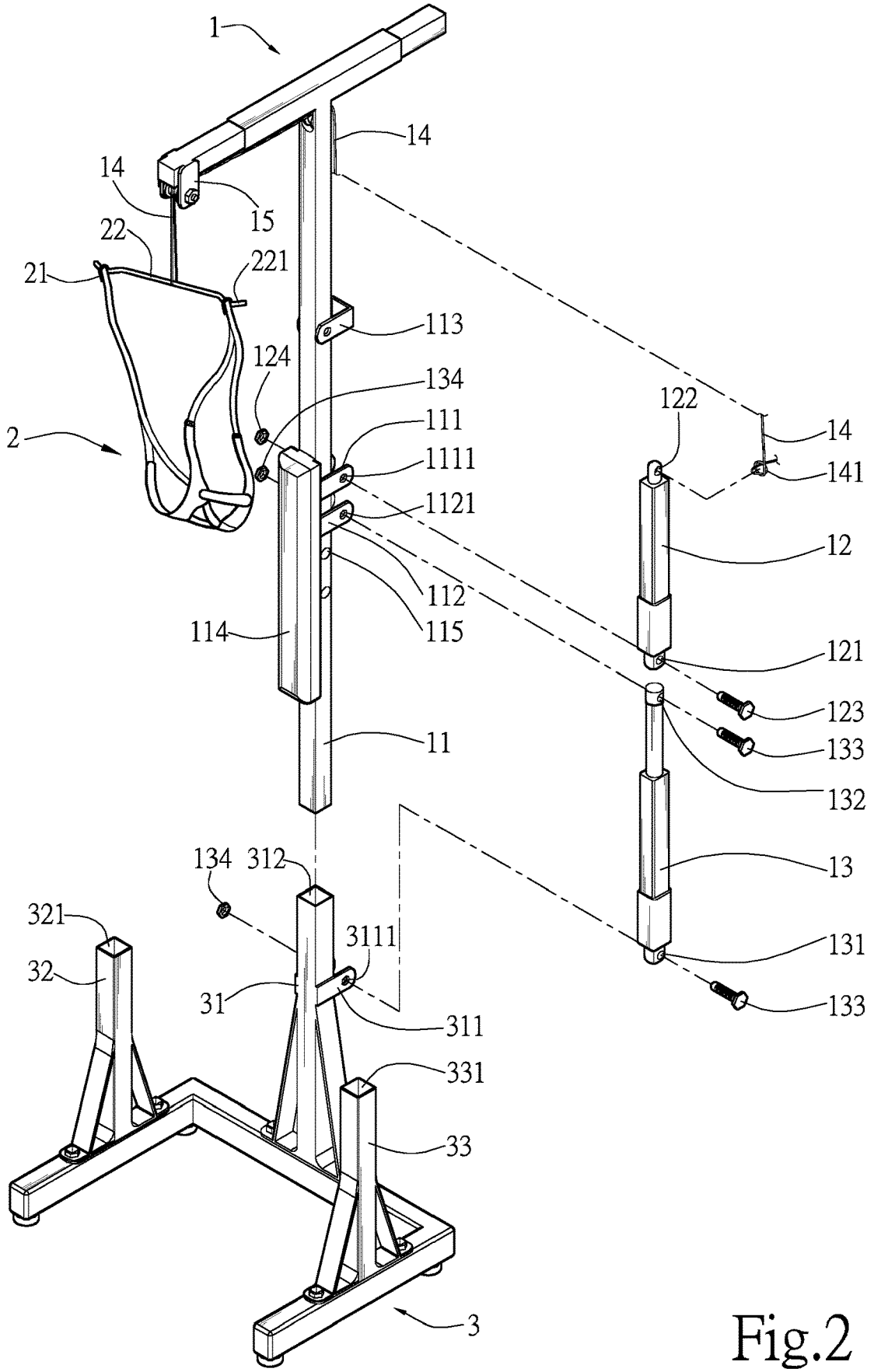
FIG. 2 is a partial exploded view of a T-shaped hanger and an n-shaped base of the present invention.
Figure 3:
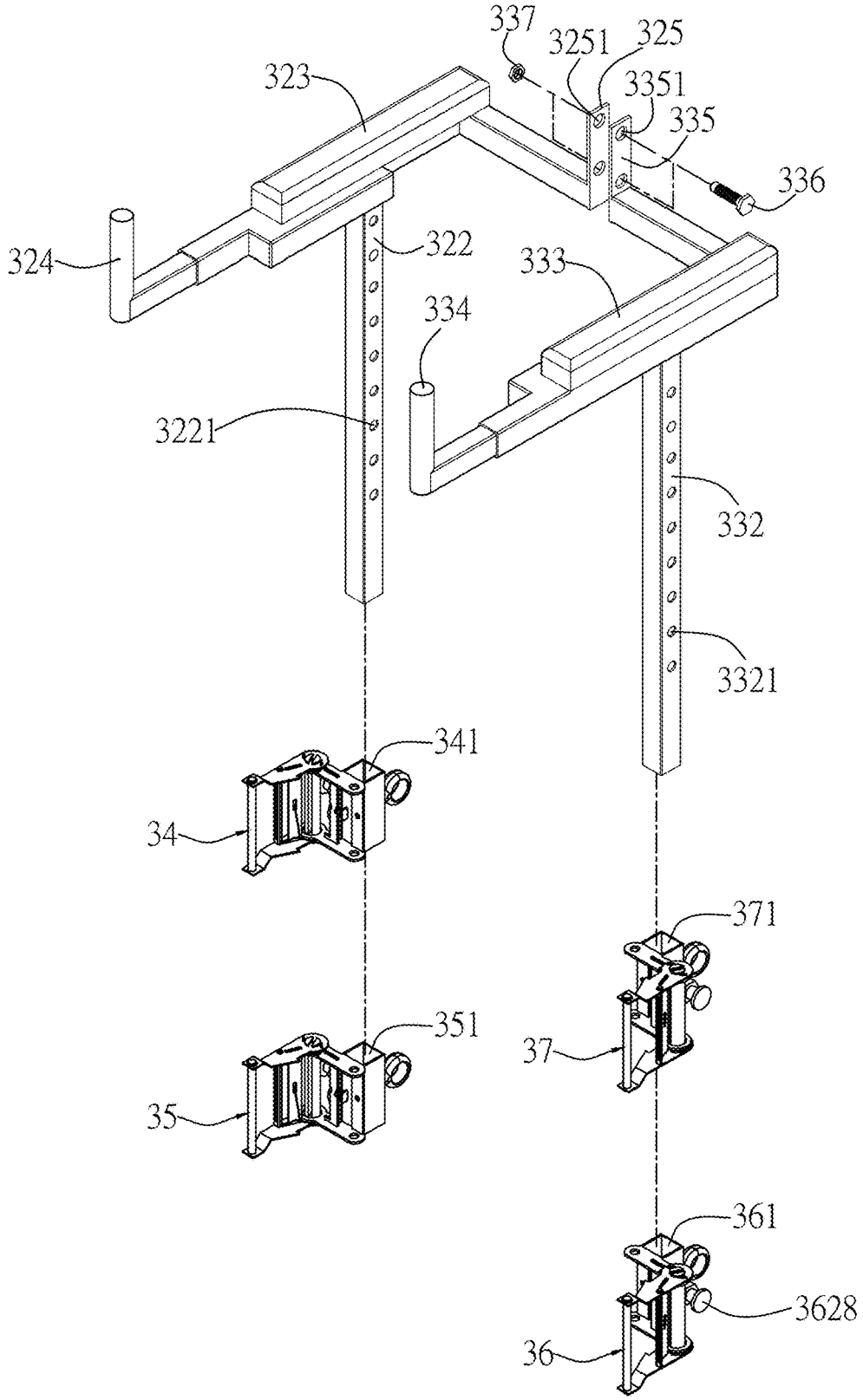
FIG. 3 is a partial exploded view depicting left and right elevating sheath mounts and adjustment belt mounts of the present invention.
Figures 1, 3:
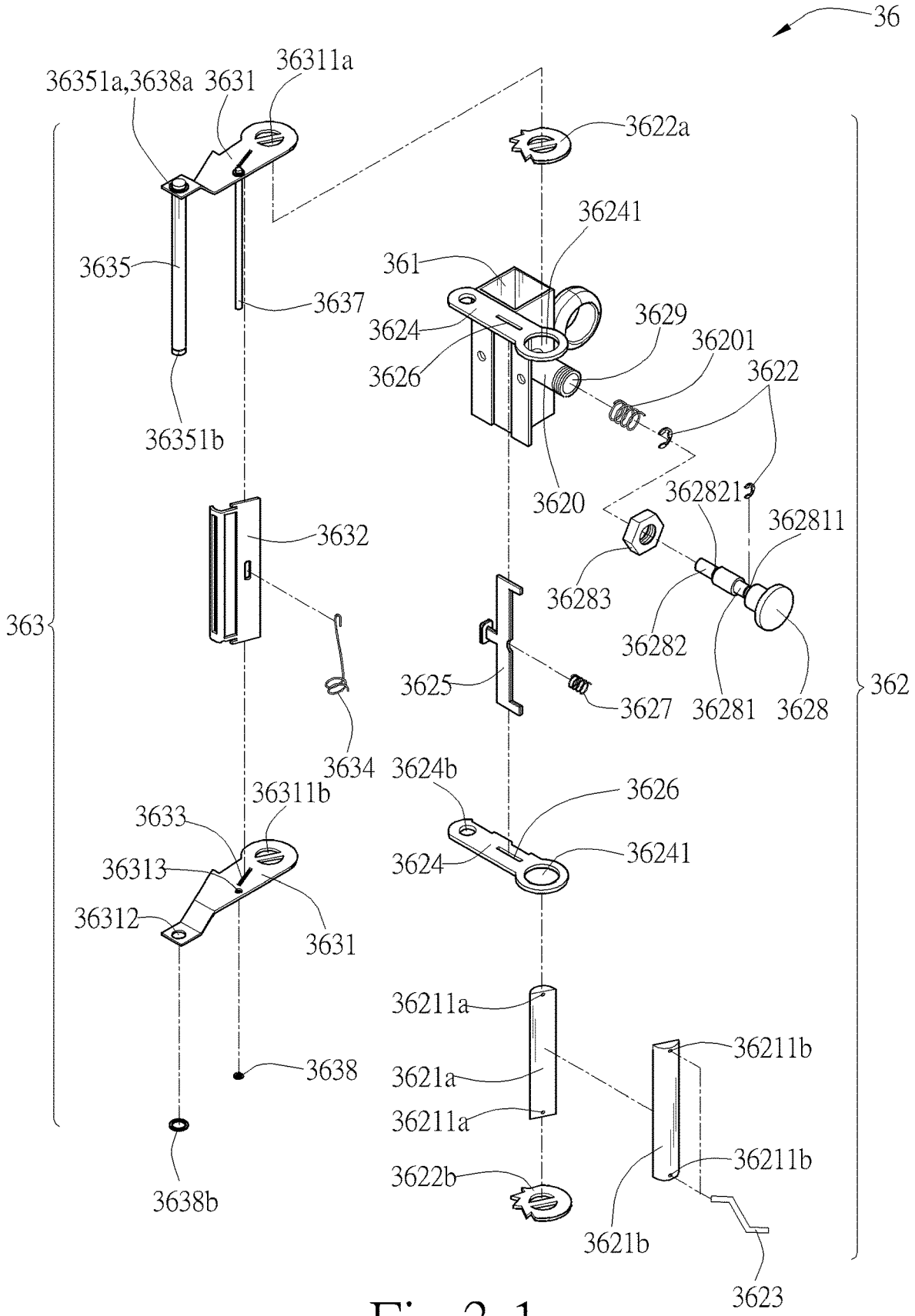
Figures 2, 3:
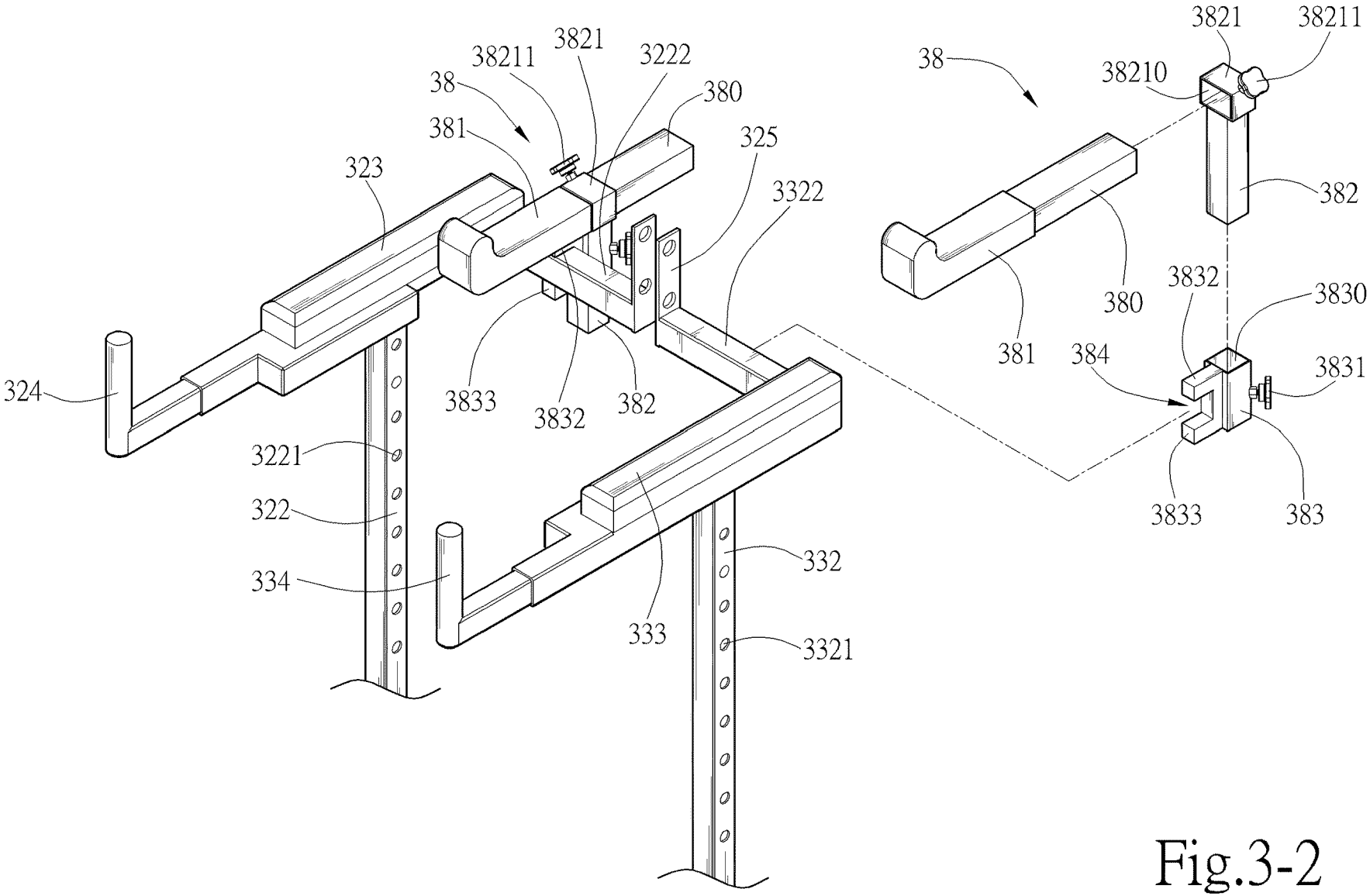
Figure 3:
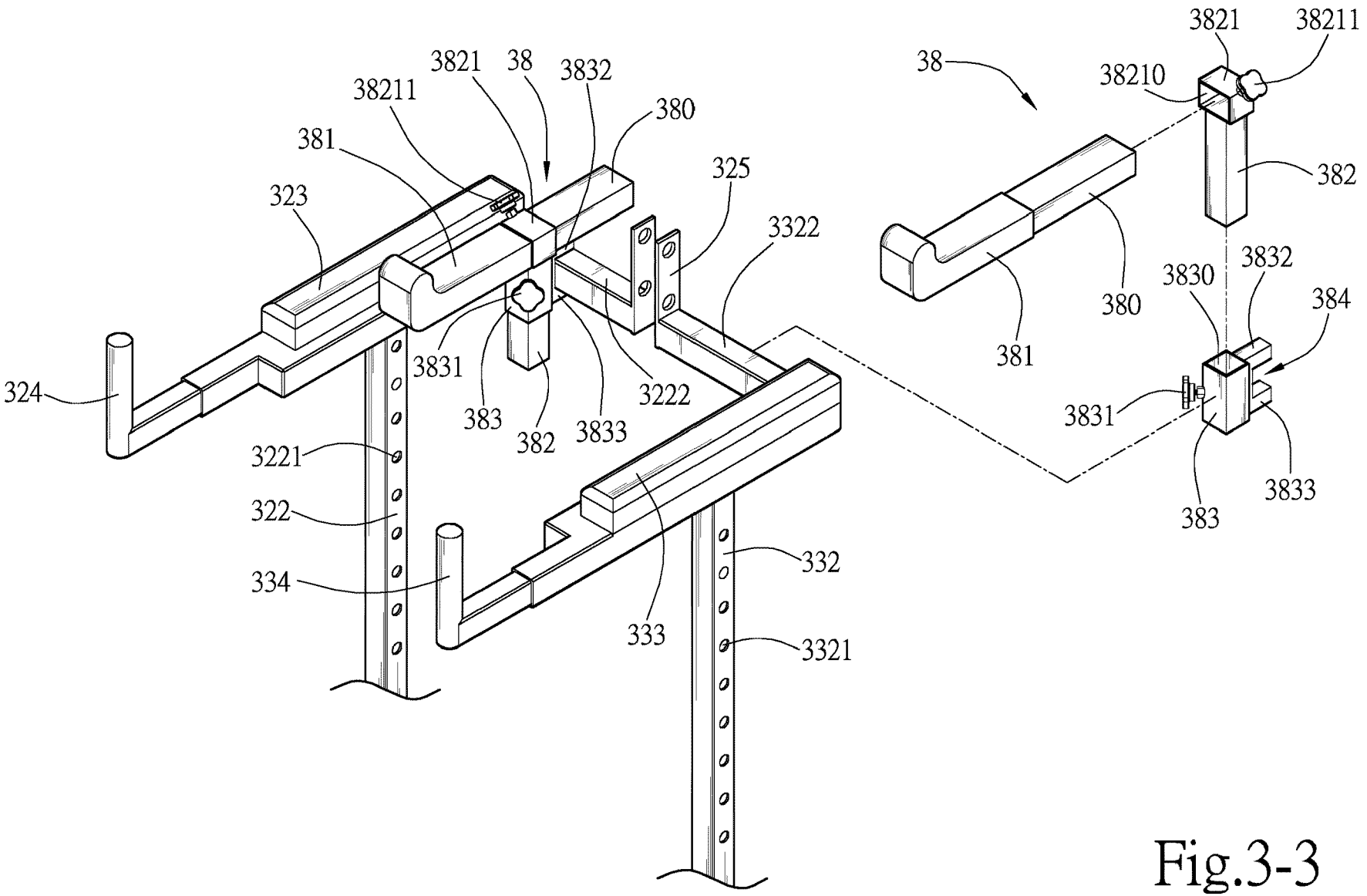

FIG. 3-2 is a diagram depicting a first preferred embodiment of underarm rods 38 of the present invention. It can be seen from the drawing that underarm rods 38 with adjustable position (up, down, forward, backward) can be installed on a left elevating crossbar 3322 and a right elevating crossbar 3222 as needed. A supporting portion 381 is provided on the underarm rods 38, which covers the front end of a supporting post 380 with a flexible material for supporting from underneath the arms of a user. The supporting post is inserted through a hole 38210 of a post mount 3821 positioned on top of a supporting rod 382, and is fastened to the post mount 3821 by tightening a fastening screw 38211 on one side of the post mount 3821. The bottom end of the supporting rod 382 is inserted into a hole 3830 of another adjusting mount 383. A fastening screw 3831 on one side of the adjusting mount 383 can be used to adjust the elevation of the supporting rod 382. The front side of the adjusting mount 383 is provided with an upper stopper 3832 and a lower stopper 3833. A recess is formed between the upper and lower stoppers 3832 and 3833, such that the underarm rod 38 can be optionally fitted onto the left or right elevating crossbar 3322 or 3222 if needed (according to heights of users or different purposes).

FIG. 3-3 is a diagram depicting a second preferred embodiment of the underarm rods 38 of the present invention. It can be seen from the drawing that the orientations of the upper stopper 3832, the lower stopper 3833 and the recess 384 formed there between are reversed in order to accommodate different body shapes or sizes or need.

Figure 7:
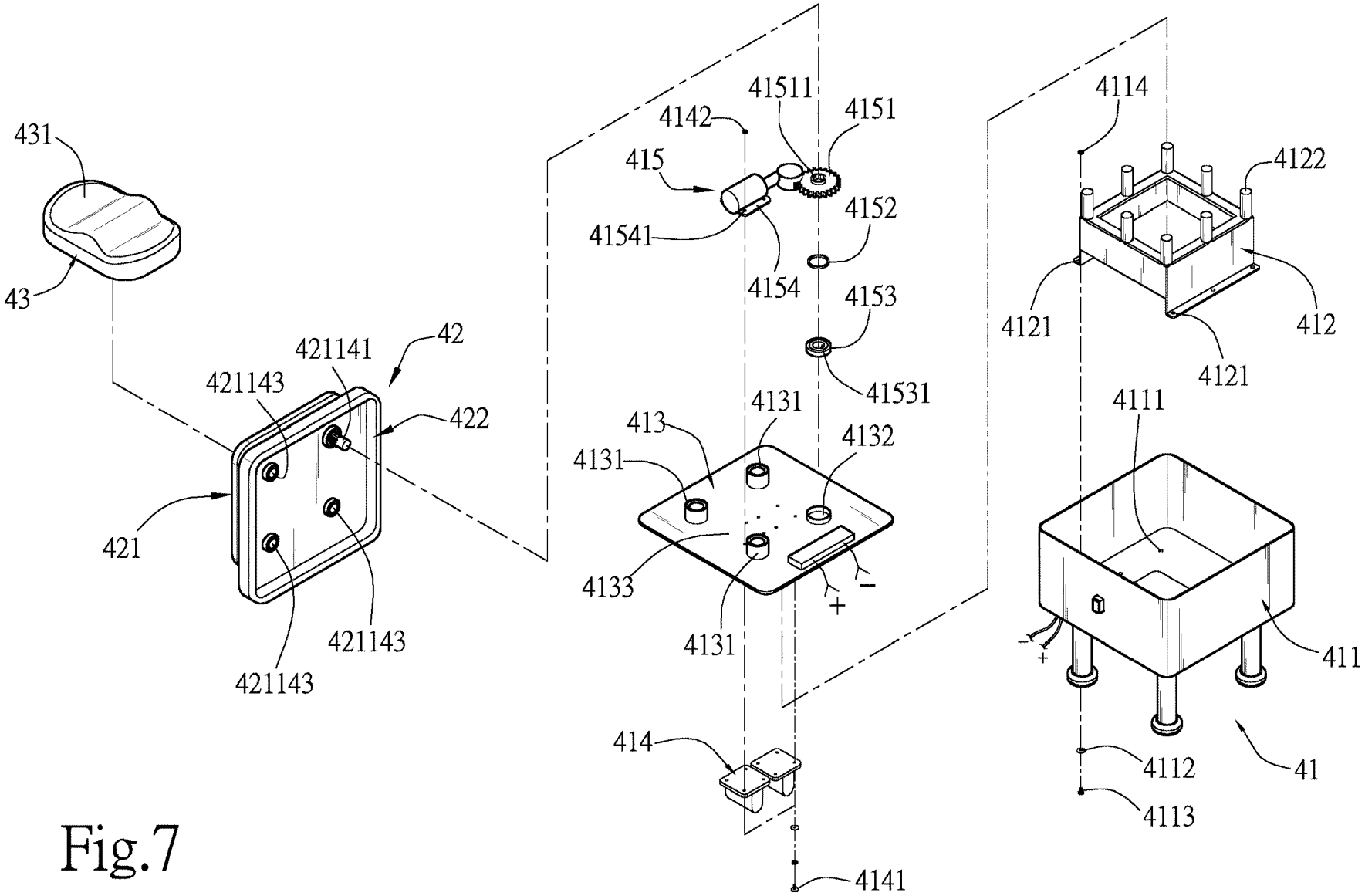
FIG. 7 is an isometric exploded view of a horizontal rotary drive platform of the present invention.
Figure 8:
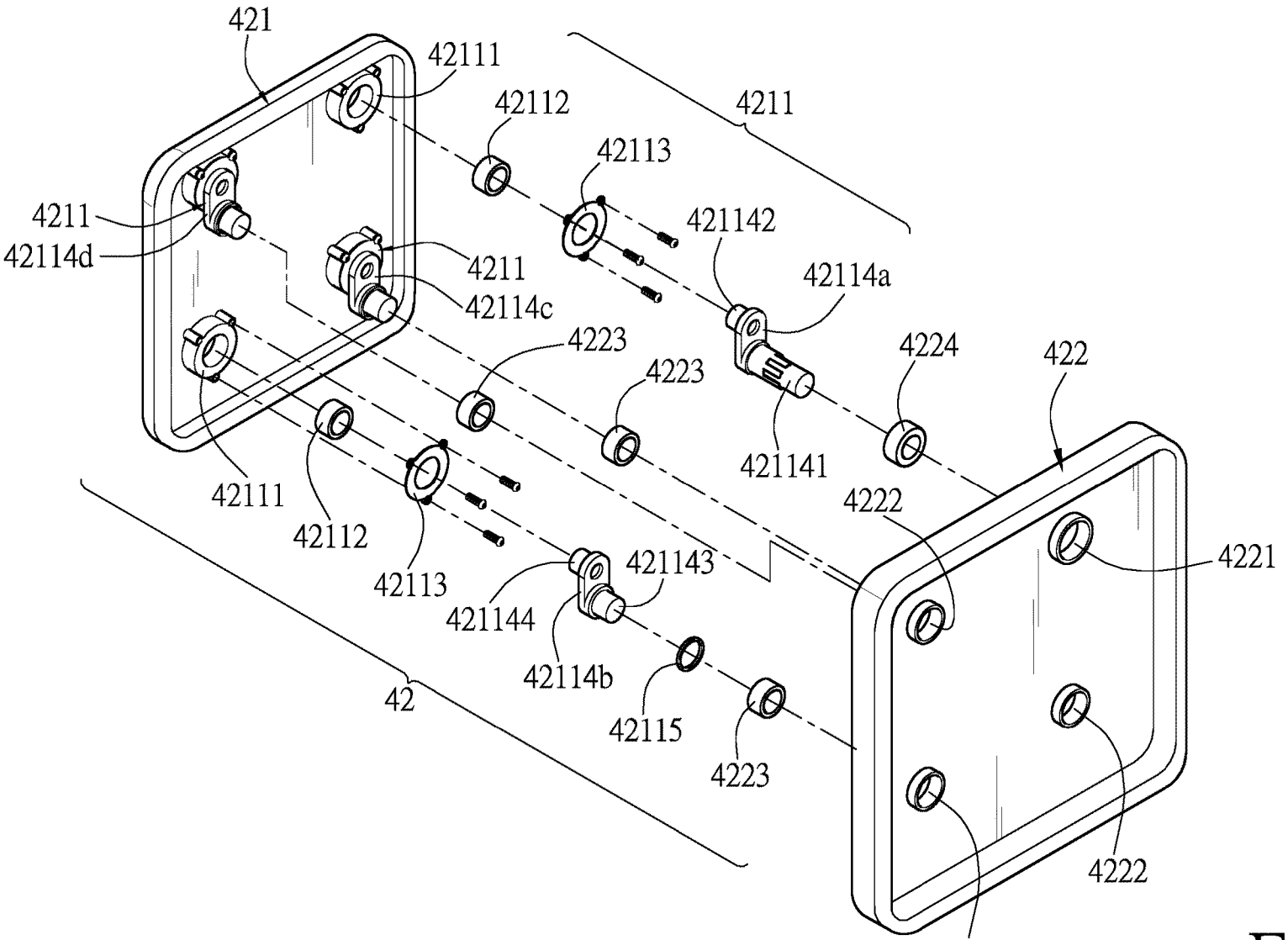
FIG. 8 is an exploded view of a drive platform of the present invention.
Figure 9:
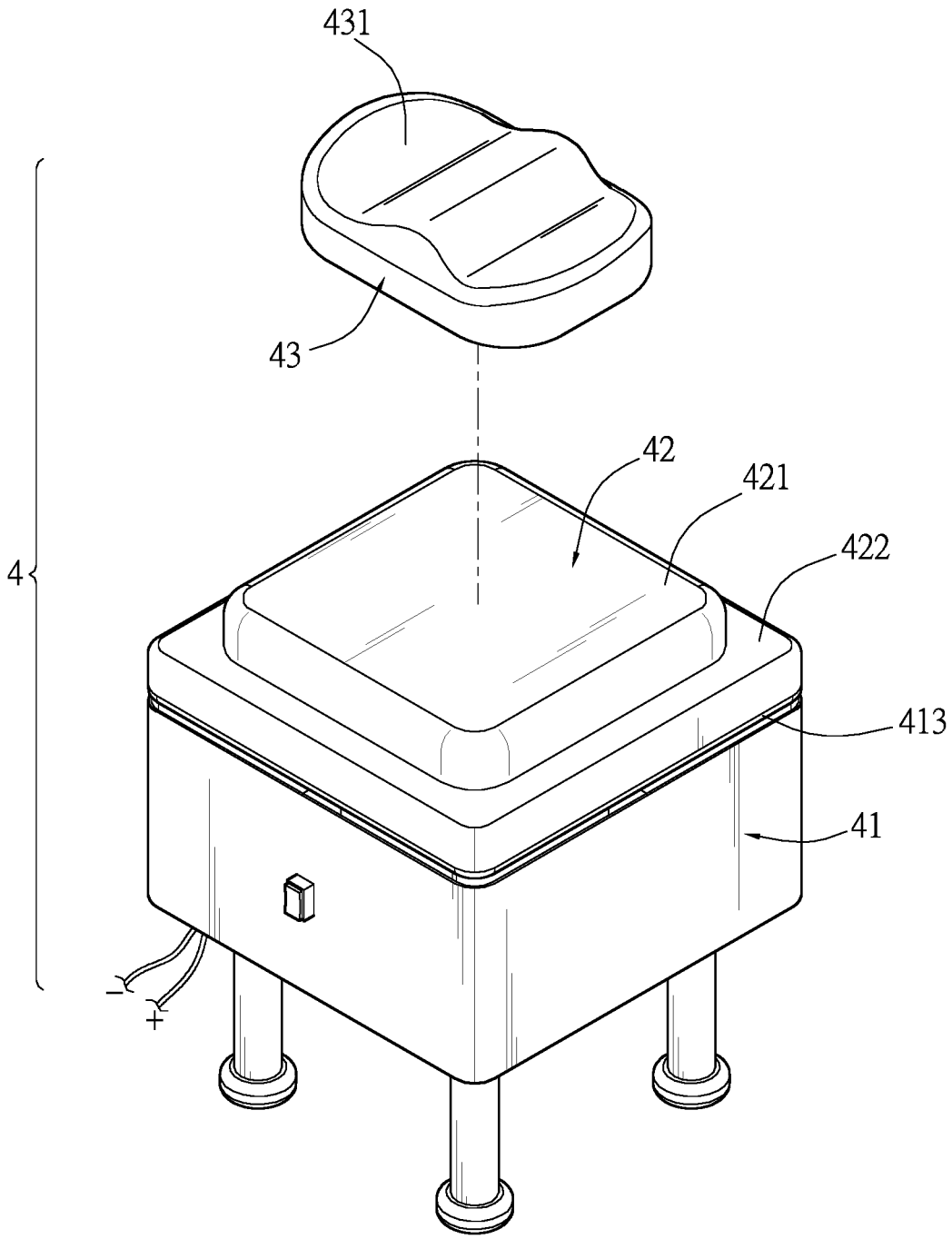
FIG. 9 is a schematic view of a first embodiment of a correction seat of the horizontal rotary drive platform of the present invention.

Referring to FIGS. 7 and 8, a horizontal rotary drive platform 4 includes a base 41, a horizontal turntable 42 and a correction seat 43. The base 41 further includes a platform base 411, an anti-shock mount 412, a rotary motor gear setting platform 413, a vibrator 414 and a motor gear set 415. The platform base 411 has a plurality of holes that can be aligned with holes 4121 on the anti-shock mount 412 and secured with the anti-shock mount 412 via gaskets 4112, screws 4113 and bolts 4114. A plurality of anti-shock pads 4122 protrude from the top of the anti-shock mount 412 to provide support for the overlying rotary motor gear setting platform 413. The rotary motor gear setting platform 413 includes a plurality of protruding fitting mounts 4131 and an indentation 4132. The vibrator 414 is positioned on the lower surface near the middle of the rotary motor gear setting platform 413. Moreover, the motor gear set 415 is provided on the top surface near the middle of the rotary motor gear setting platform 413. The motor gear set 415 meshes a drive gear 4151. A gear hole 41511 of the drive gear 4151 is aligned with an elastic gasket 4152 and a hole 41531 of a bearing 4153. The bearing 4153 is fitted inside the indentation 4132 of the rotary motor gear setting platform 413. The horizontal turntable 42 is provided on top of the rotary motor gear setting platform 413. The horizontal turntable 42 includes a turntable top part 421 and a turntable bottom part 422. A plurality of eccentric rotation axis assemblies 4211 (i.e. bearing assemblies) are located near the corners of the turntable top part 421. One eccentric rotation axis assembly 4211 includes a securing mount 42111, a top bearing 42112, an elastic bearing securing plate 42113, a first eccentric shaft 42114*a*, and a bottom bearing 4224. The top bearing 42112 is fitted into the securing mount 42111. The elastic bearing securing plate 42113 is secured onto the securing mount 42111. The first eccentric shaft 42114*a* has a long shaft 421141 and a short shaft 421142 on opposite sides. The long shaft 421141 of the first eccentric shaft 42114*a* passes through the bottom bearing 4224 and a hole 4221 of the turntable bottom part 422. The long shaft 421141 then passes through the drive gear 4151, the elastic gasket 4152, the bearing 4153 via the gear hole 41511 and the bearing hole 41531.

In addition, a second eccentric shaft 42114*b*, a third eccentric shaft 42114*c*, and a fourth eccentric shaft 42114*d* are similar driven elements, and only the second eccentric shaft 42114*b* is explained below for simplicity. The second eccentric shaft 42114*b* includes a supporting shaft 421143 and a short shaft 4211 on opposite sides. The supporting shaft 421143 passes through an elastic gasket 42115, a bottom bearing 4223, and into a hole 4222 of the turntable bottom part 422. The bottom bearing 4223 is also fitted on a corresponding fitting mount 4131 on the rotary motor gear setting platform 413. An inertial centrifugal force is generated when the horizontal turntable 42 is turning, which drives the correction seat 43 placed on top of it.

There are many possible implementations of the correction seat 43 to achieve different rhythmic motion patterns, in particular, three exemplary rhythmic motion patterns are described below with reference to FIGS. 9, 12, 12-1, 12-3, 13, 14, 14-1, 14-2, 15, 16, 16-1 and 16-2.

A first implementation is a curved seat 431, wherein the top surface is curved and the bottom surface is flat, so it can be stably placed on the horizontal turntable 42. A second implementation is a balance disk 432 with curved top and bottom. A third implementation is a balance ball 433 wherein the top surface is flat and the bottom is semi-circular.

Figure 12:
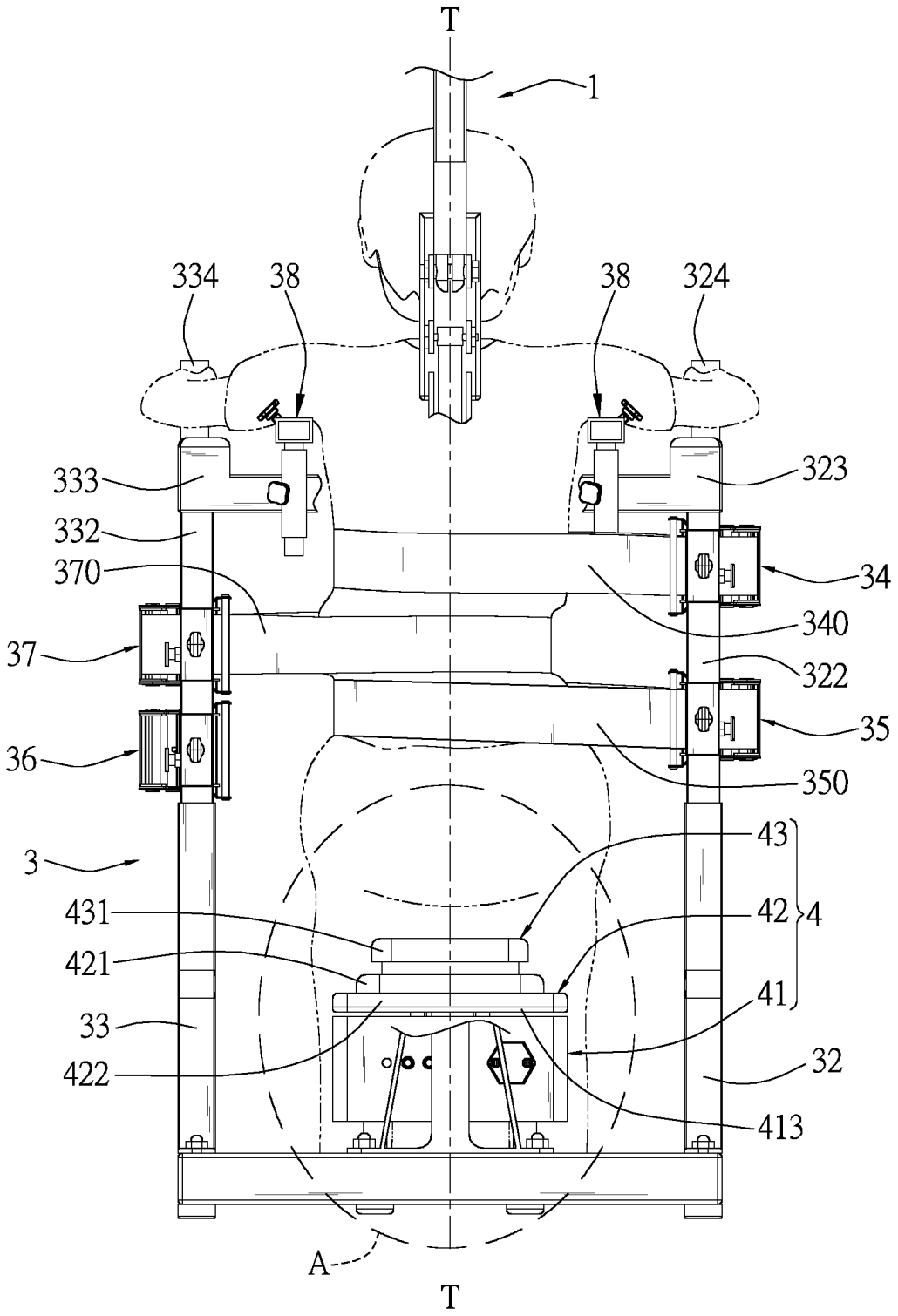
FIG. 12 is a back view of the correction seat used in combination with the underarm rods according to the present invention.
Figures 1, 12:
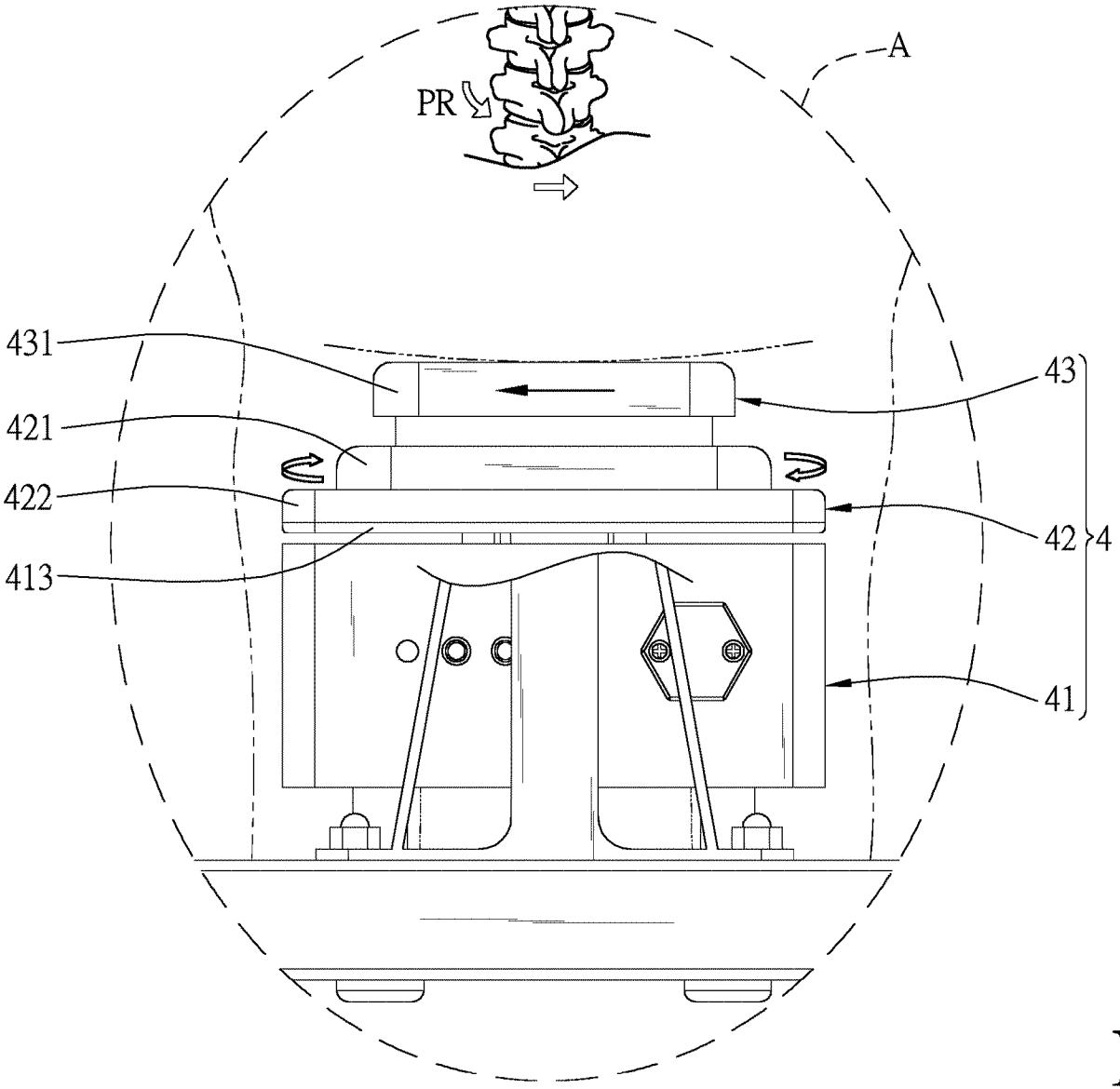
Figures 2, 12:
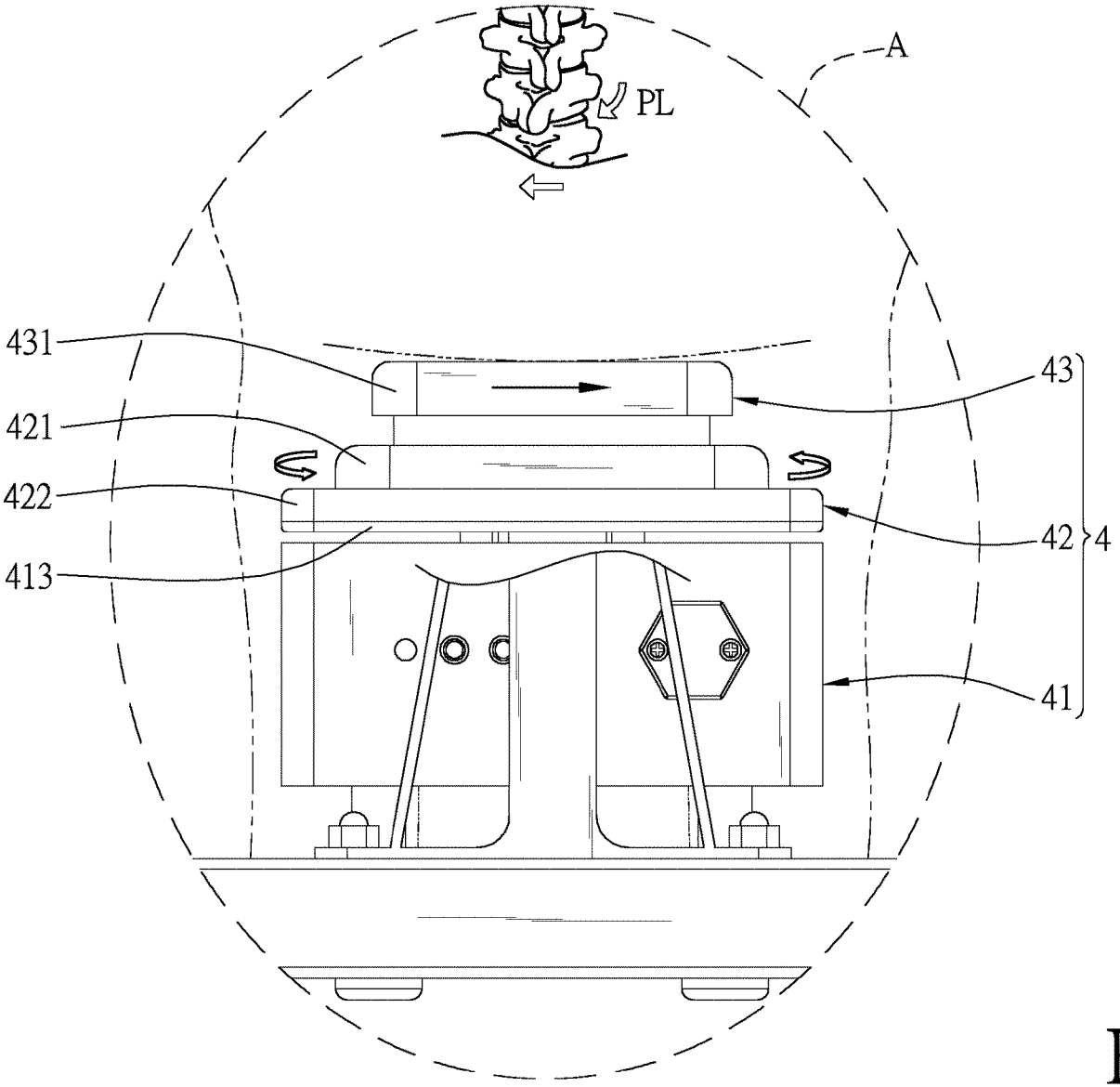
Figure 13:
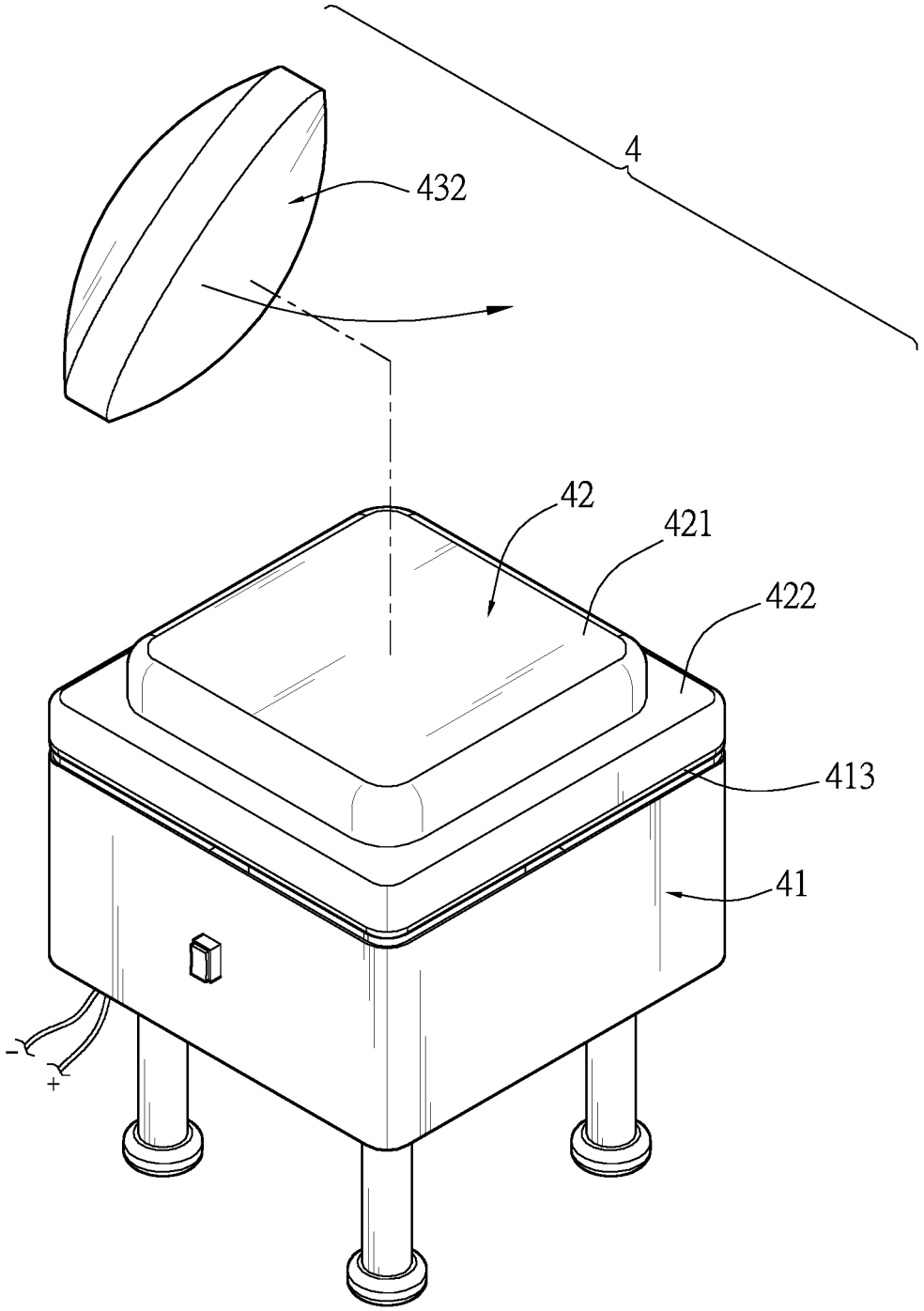
FIG. 13 is a schematic view of a second embodiment of the correction seat of the present invention.

Referring to FIGS. 9, 12, 12-1 and 12-2, a schematic view of a first embodiment of the correction seat of the present invention, a back view of the correction seat in use, a partially enlarged view of section A of FIG. 12 showing a first regularity rotation motion pattern of the lumbar spine, and a partially enlarged view of section A of FIG. 12 showing a second regularity rotation motion pattern of the lumbar spine are shown, respectively. As can be seen from the drawings, a user rests his arms on the left and right handle pads 333 and 323, which can be adjusted according to the height of the user. Ideally, the arms are lifted slightly to raise the spine and reduce stacking, such that there is no gravity oppression from the scapula to the pelvis of the lumbar spine in order to facilitate returning the spine to its correct place. The horizontal rotary drive platform 4 allows the pelvis to swing left or right regularly at 10~60 times per minute. For example, if the spine is twisted, then the curved seat 431 can be used and turned in an opposite direction to the direction of the twist. As shown in FIG. 12-1, the seat is turned clockwise for a patient with a right-twisted lumbar spine (shown by arrows PR). In FIG. 12-2, the seat is turned anti-clockwise for a patient with a left-twisted lumbar spine (shown by arrows PL).

Figure 14:
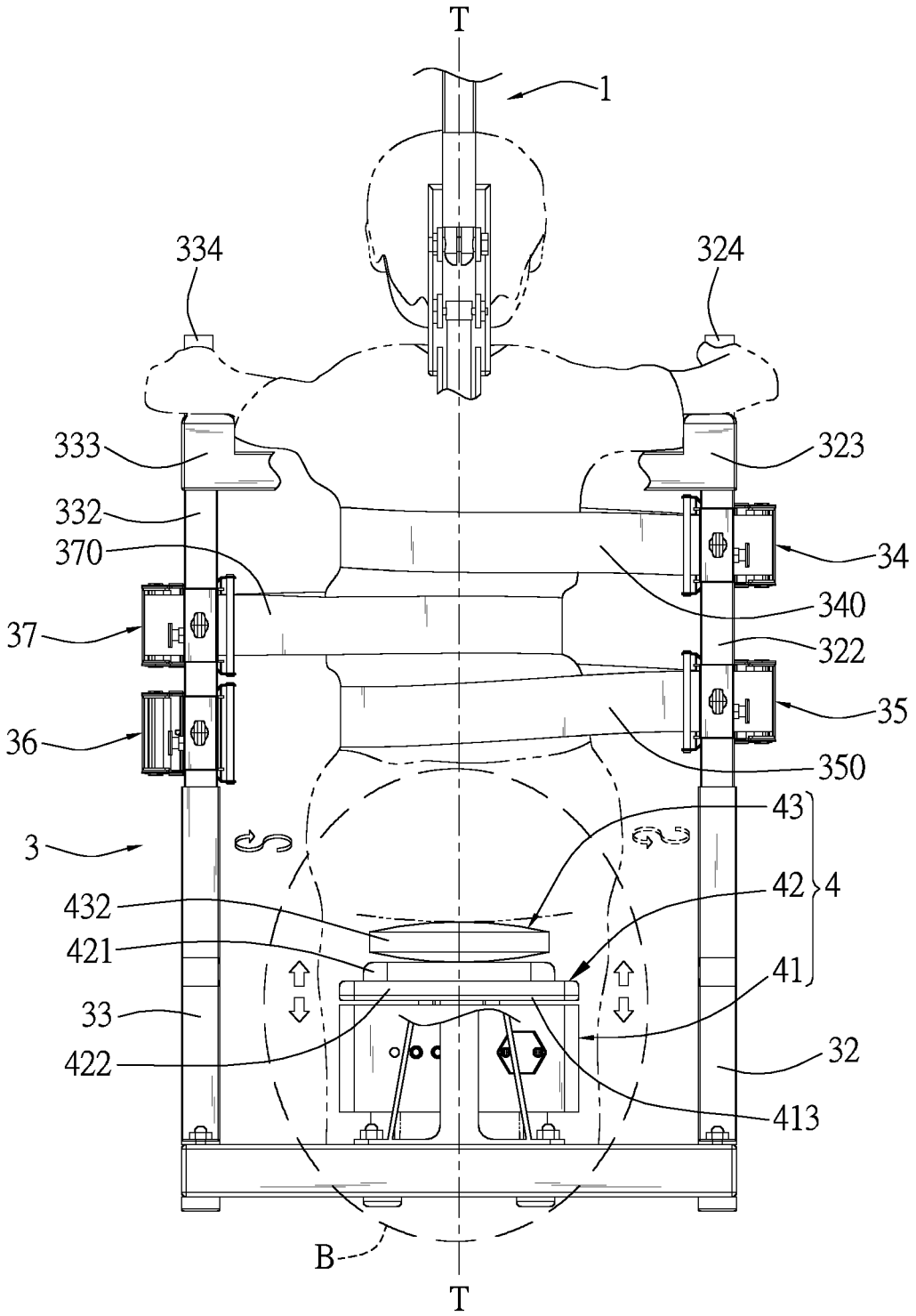
FIG. 14 is a back view of the correction seat in use.
Figures 1, 14:
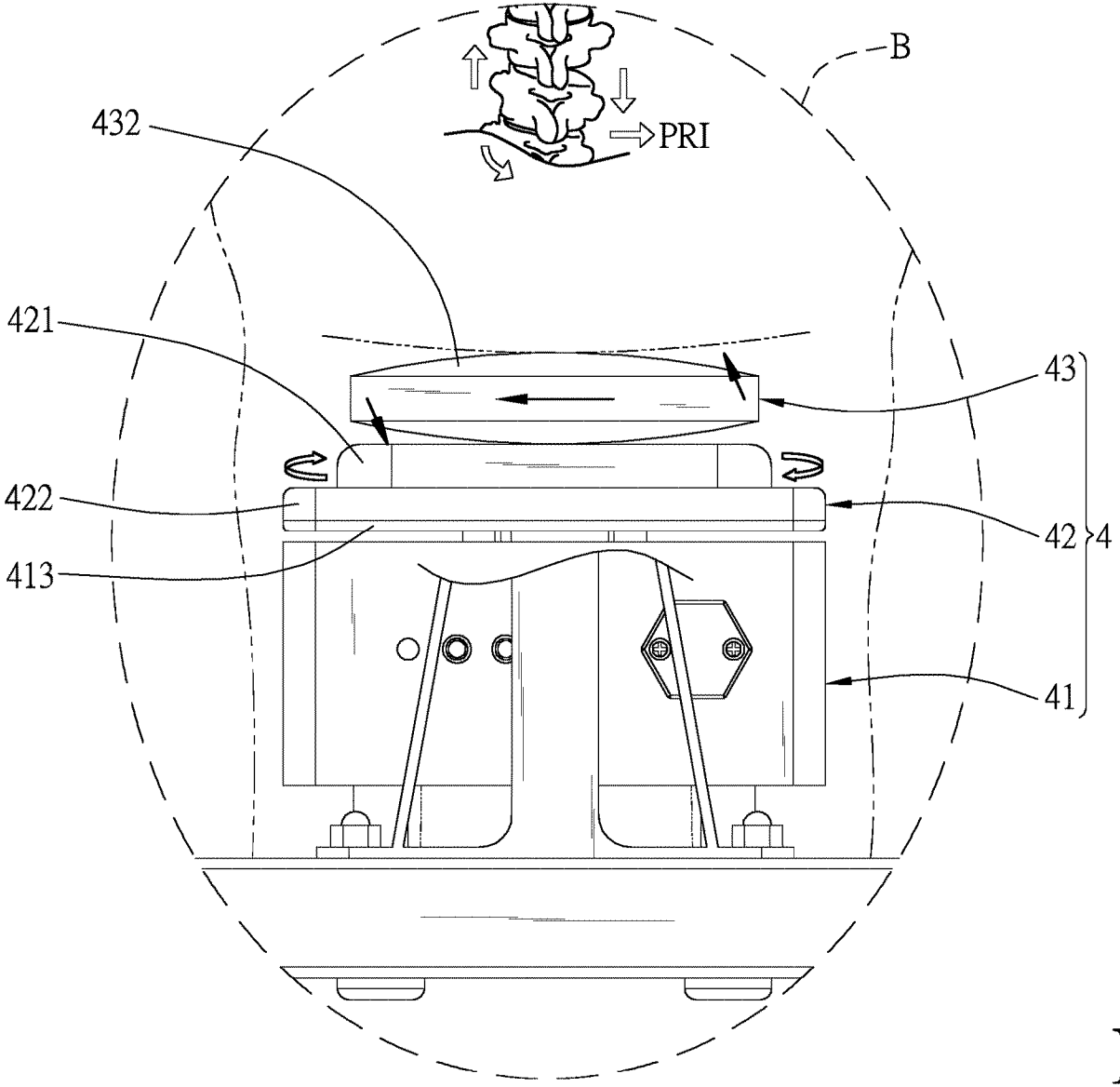
Figures 2, 14:
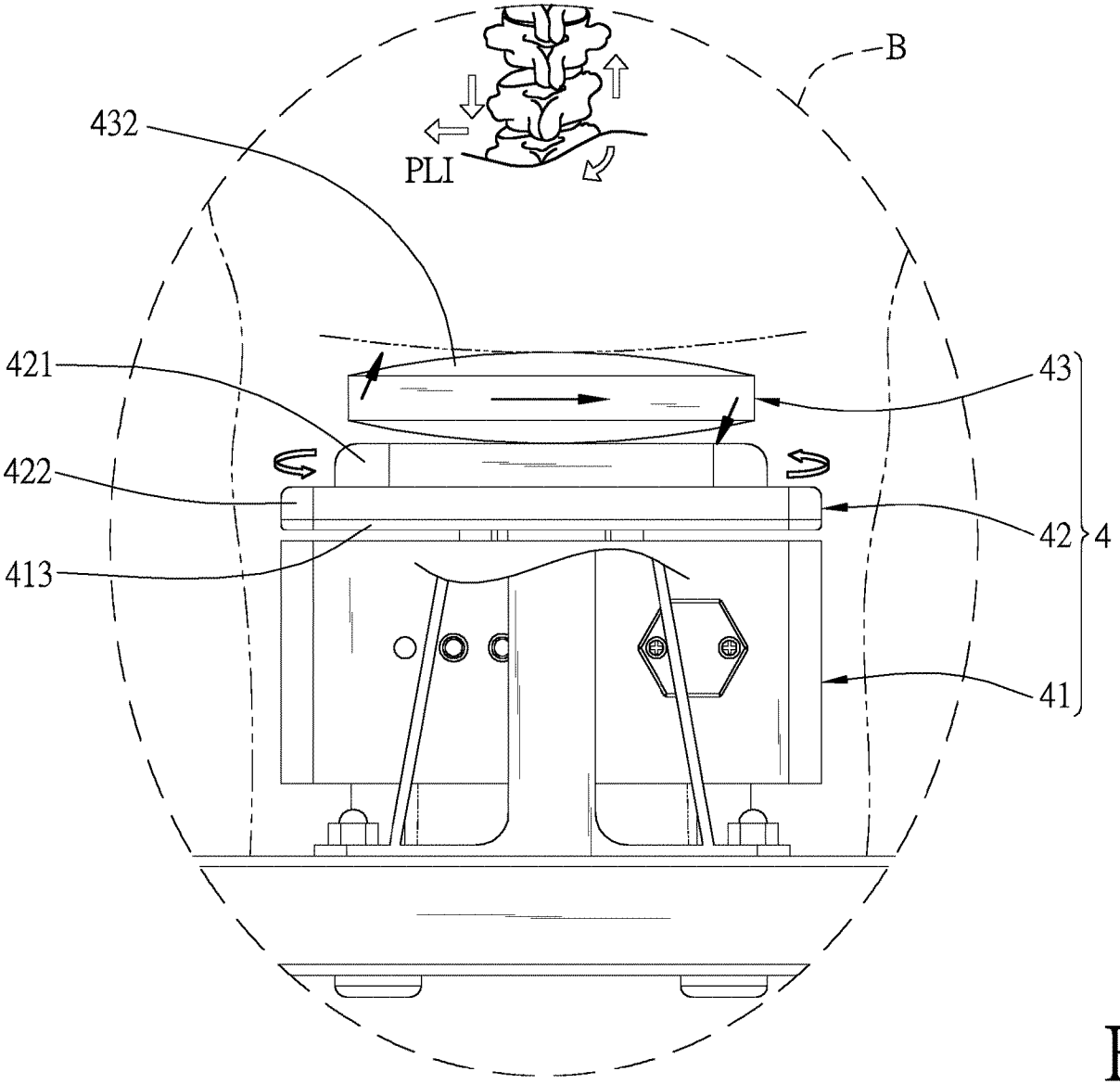
Figure 15:
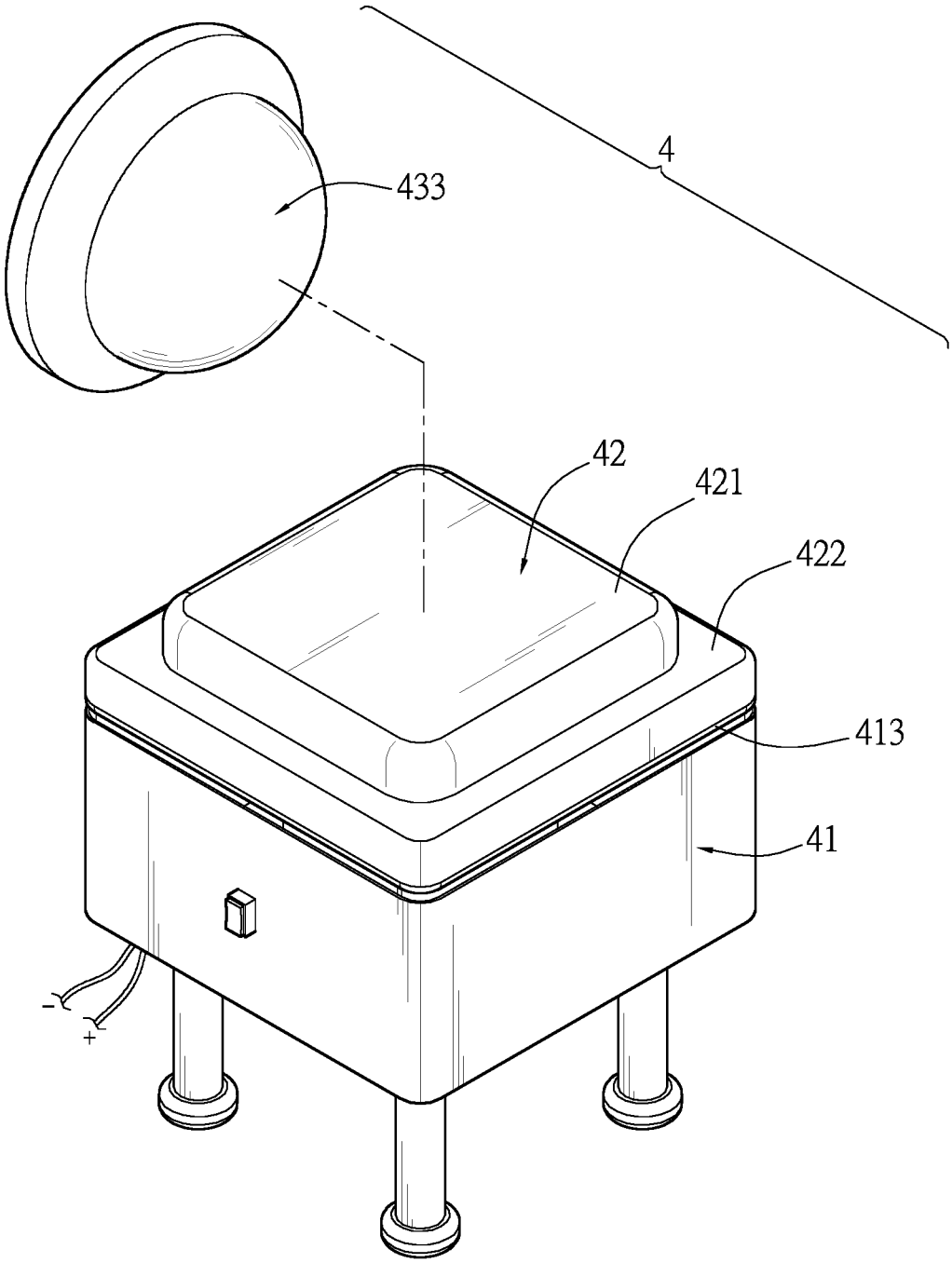
FIG. 15 is a schematic view of a third embodiment of the correction seat of the present invention.

As shown in FIGS. 13, 14, 14-1 and 14-2, a schematic view of a second embodiment of the correction seat of the present invention, a back view of the correction seat in use, a partially enlarged view of section B of FIG. 14 showing a third regularity rotation motion pattern of the lumbar spine, and a partially enlarged view of section B of FIG. 14 showing a fourth regularity rotation motion pattern of the lumbar spine are shown, respectively. The horizontal rotary drive platform 4 allows the pelvis to rotate along an S shape regularly at 10~60 times per minute. For example, if the lumbar spine is bent and twisted, then the balance disk 432 can be used. As shown in FIG. 14-1, for a patient with the lumbar spine twisted and bent to the right (shown by arrows PRI), the balance disk 432 is turned clockwise and in opposite direction to the bent lumbar spine. In FIG. 14-2, for a patient with the lumbar spine twisted and bent to the left (shown by arrows PLI), the balance disk 432 is turned anti-clockwise and in opposite direction to the bent lumbar spine.

Figure 16:
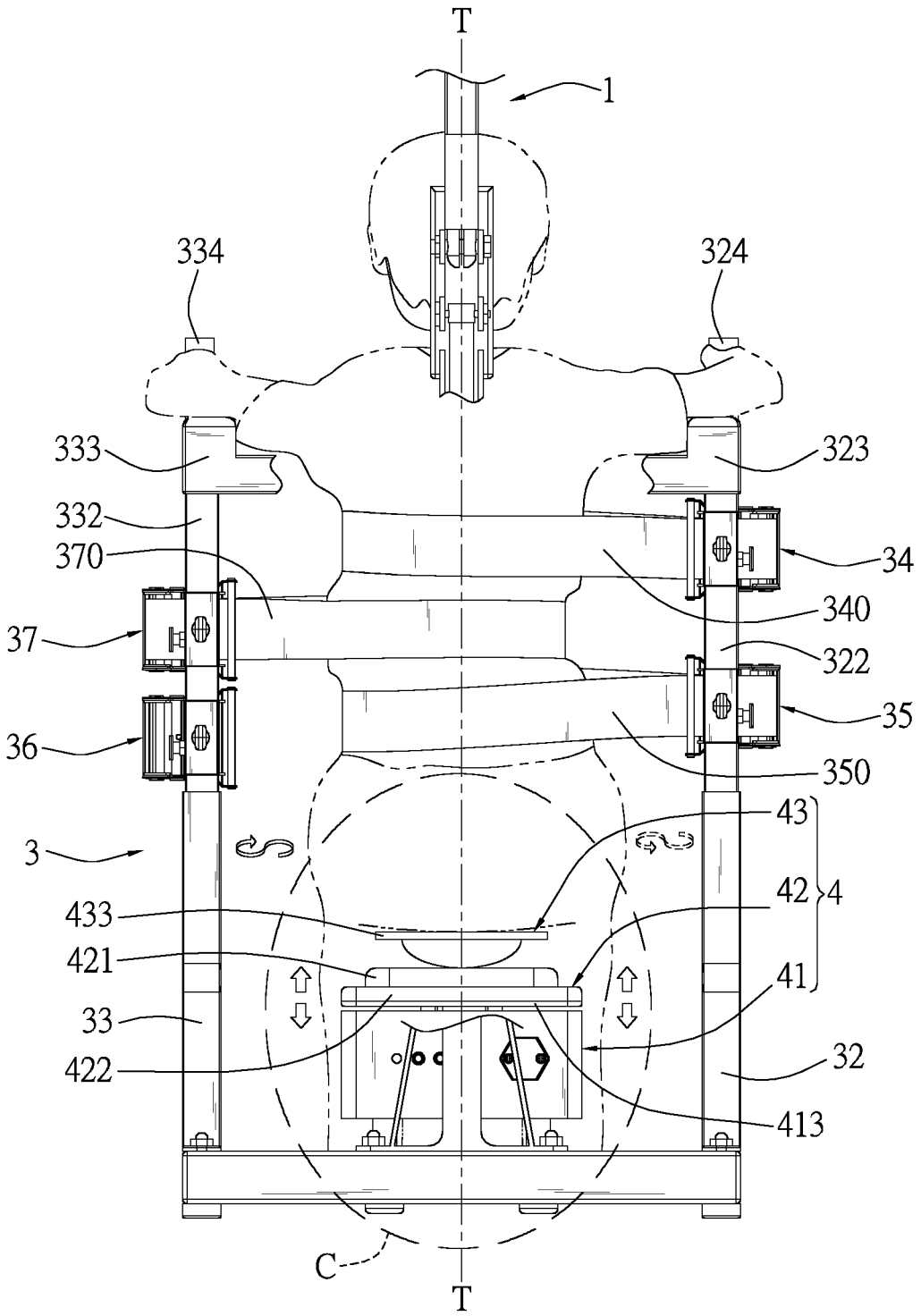
FIG. 16 is a back view of the correction seat in use.
Figures 1, 16:
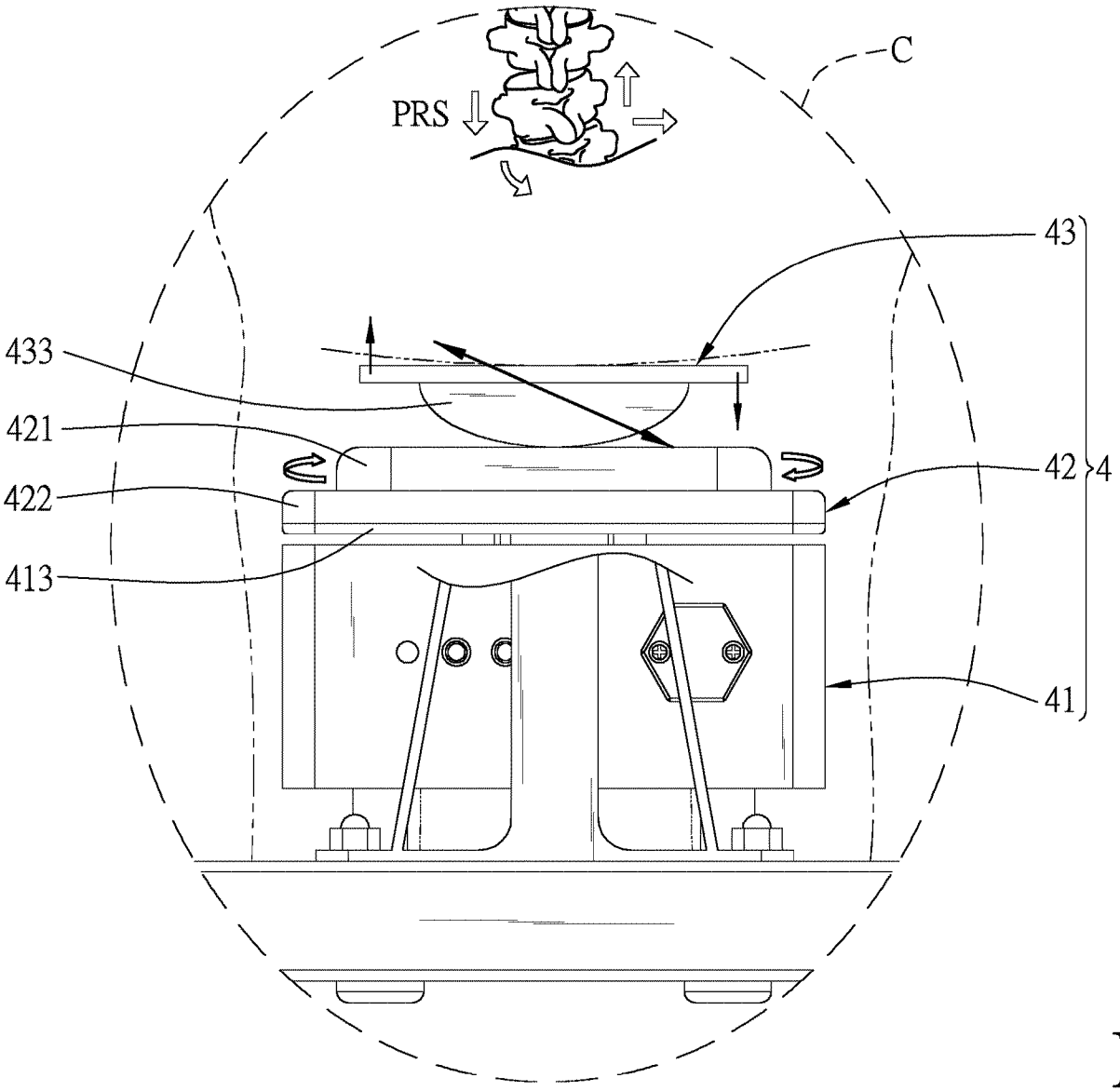
Figures 2, 16:
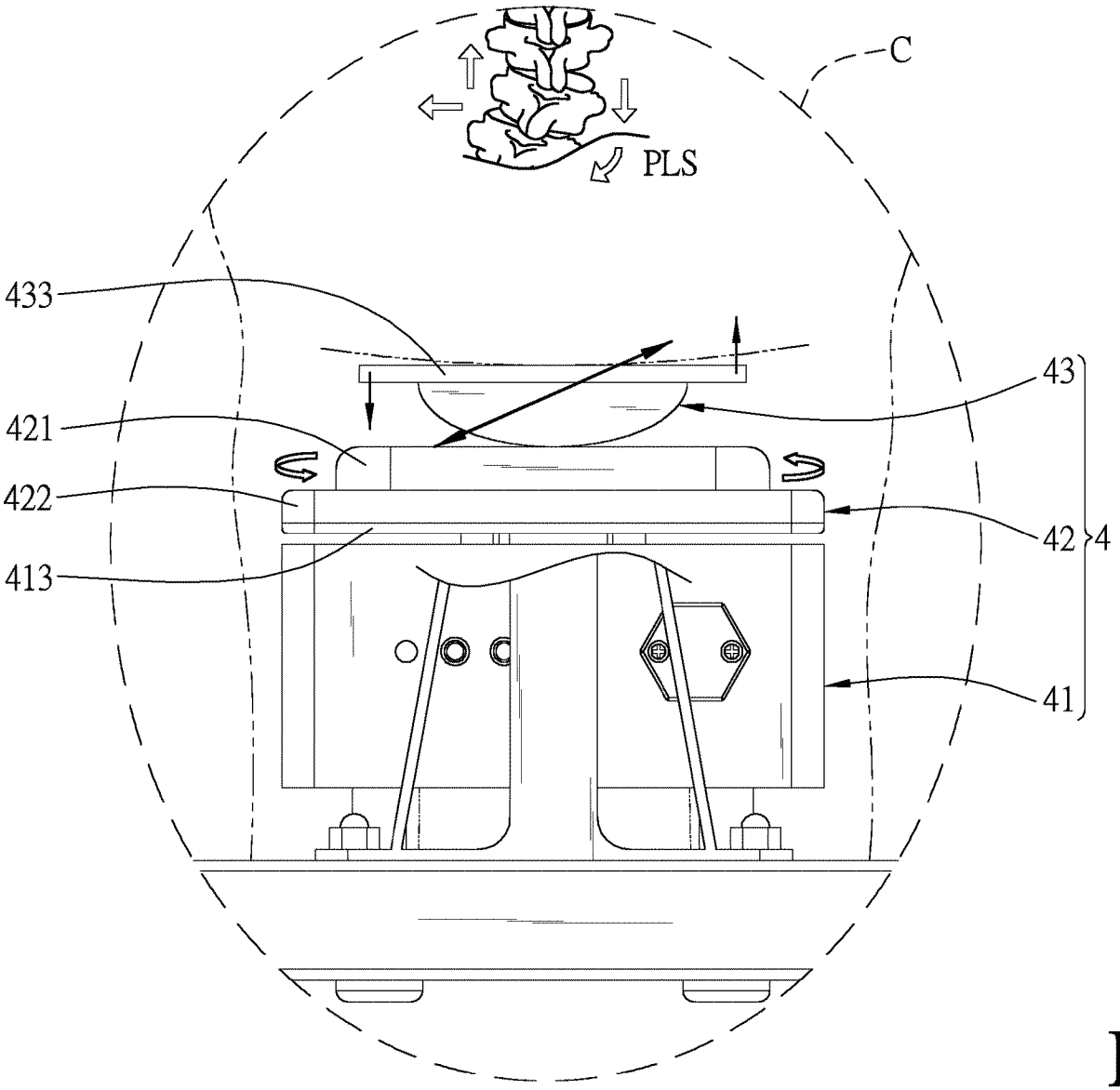

As shown in FIGS. 15, 16, 16-1 and 16-2, a schematic view of a third embodiment of the correction seat of the present invention, a back view of the correction seat in use, a partially enlarged view of section C of FIG. 16 showing a fifth rhythmic motion pattern of the lumbar spine, and a partially enlarged view of section C of FIG. 16 showing a sixth regularity rotation motion pattern of the lumbar spine are shown, respectively. The horizontal rotary drive platform 4 allows the pelvis to rotate in an S shape regularly at 10~60 times per minute. For example, if the pelvis is skew, then the balance ball 433 can be used. As shown in FIG. 16-1, for a patient with part of the spine bent to the right (shown by arrows PRS), the balance ball 433 is turned clockwise and in opposite direction and angle to the bent spine. In FIG. 16-2, for a patient with part of the spine bent to the left (shown by arrows PLS), the balance ball 433 is turned anticlockwise and in opposite direction and angle to the bent lumbar spine.

In addition to the above actions, the vibrator 414 beneath the horizontal turntable 42 and the rotary motor gear setting platform 413 can generate high-speed vibrations when the weight of the user is applied on the correction seat 43, for example, at 1000 times per minute, to loosen the vertebral joints and help in redressing the lumbar spine. In conclusion, the lumbar regularity rotation motion device of the present invention is applicable to physiotherapy of the spine by gently raising the head to reduce the weight and increase the space between the cervical joints with adjustable neck traction belt; redressing thoracic scoliosis through optional adjustment belts pulled at either side of the chest; and redressing twisted or bent lumbar spine or pelvis skew using a correction seat of an appropriate shape that moves in a reverse direction to the twisted, bent or skewed direction.

Slowing the degree of vertebral soreness, or thoracic scoliosis, lumbar rotation, bending, pelvic tilt symptoms In view of this, the present invention is submitted to be novel and non-obvious and a patent application is hereby filed in accordance with the patent law. It should be noted that the descriptions given above are merely descriptions of preferred embodiments of the present invention, various changes, modifications, variations or equivalents can be made to the invention without departing from the scope or spirit of the invention. It is intended that all such changes, modifications and variations fall within the scope of the following appended claims and their equivalents.

What is claimed is:

1. A lumbar regularity rotation motion device comprising:

a base including an enclosure with an opening on one side and a main elevating post sheath mount extending vertically from a side of the enclosure opposite to the opening;

a hanger including:

a main elevating post sheathed in the main elevating post sheath mount, a first power telescopic actuator fastened to the main elevating post at one end, a pulling belt fastened to the first power telescopic actuator at one end, and an arm extending perpendicularly from the main elevating post including a pulley at the distal end for guiding the pulling belt;

a neck traction belt held in suspension on the other end of the pulling belt via the pulley; and a horizontal rotary drive platform including:

a horizontal turntable driven by a motor gear set, and a seat provided on top of the horizontal turntable for moving in a rhythmic manner actuated by the horizontal turntable, wherein the horizontal turntable includes a turntable top part with first and second eccentric rotation axis assemblies and a turntable bottom part, and at least one of the first eccentric rotation axis assembly includes a first securing mount, a first top bearing a first elastic bearing securing plate, a first eccentric shaft, and a first bottom bearing, and the second eccentric rotation axis assembly includes a second securing mount, a second top bearing, a second elastic bearing securing plate, a second eccentric shaft, an elastic gasket, and a second bottom bearing.

2. The lumbar regularity rotation motion device of claim 1, wherein the first eccentric shaft includes a long shaft and a short shaft on opposite sides, the long shaft passes through the bottom bearing and the turntable bottom part to couple with the motor gear set.

3. The lumbar regularity rotation motion device of claim 1, wherein the second eccentric shaft includes a supporting shaft that passes through the bottom bearing and the turntable bottom part to couple with a rotary motor gear setting platform on which the motor gear set is provided.

* * * * *